US009051801B1

(12) United States Patent
Mintz

(10) Patent No.: US 9,051,801 B1
(45) Date of Patent: Jun. 9, 2015

(54) DUAL MODALITY CONTAINER FOR STORING AND TRANSPORTING FRAC SAND AND FRAC LIQUID

(71) Applicant: Michael Mintz, Corpus Christi, TX (US)

(72) Inventor: Michael Mintz, Corpus Christi, TX (US)

( * ) Notice: Subject to any disclaimer, the term of this patent is extended or adjusted under 35 U.S.C. 154(b) by 0 days.

(21) Appl. No.: 14/580,061

(22) Filed: Dec. 22, 2014

Related U.S. Application Data

(63) Continuation-in-part of application No. 13/342,107, filed on Jan. 1, 2012, now Pat. No. 8,915,691.

(51) Int. Cl.
*B65G 51/00* (2006.01)
*E21B 27/02* (2006.01)

(52) U.S. Cl.
CPC ..... *E21B 27/02* (2013.01)

(58) Field of Classification Search
USPC ..... 406/76, 93, 118, 123, 127, 134, 137, 406/146, 198; 414/305; 166/75.15
See application file for complete search history.

(56) References Cited

U.S. PATENT DOCUMENTS

| | | | | |
|---|---|---|---|---|
| 5,215,228 | A * | 6/1993 | Andrews et al. | 222/203 |
| 5,490,561 | A * | 2/1996 | Cardoso-Neto et al. | 166/264 |
| 5,697,523 | A * | 12/1997 | Brandauer | 222/58 |
| 5,899,272 | A * | 5/1999 | Loree | 166/280.2 |
| 6,283,680 | B1 * | 9/2001 | Vidal | 406/128 |
| 7,040,401 | B1 * | 5/2006 | McCannon | 166/250.15 |
| 7,987,928 | B2 * | 8/2011 | Vuyk et al. | 175/67 |
| 8,616,358 | B2 * | 12/2013 | Dunn et al. | 193/25 B |
| 8,689,494 | B2 * | 4/2014 | Leavitt | 52/63 |
| 2009/0050446 | A1 * | 2/2009 | Cliff et al. | 198/546 |

* cited by examiner

*Primary Examiner* — Joseph Dillon, Jr.
(74) *Attorney, Agent, or Firm* — Harrison Law Office, P.C.

(57) ABSTRACT

A dual modality container for transporting either frac sand and proppant or frac liquids for temporary storage and delivery to a well site for fracking operations. In a first modality, a plurality of inlet ports disposed atop the container roof receives frac sand from a frac sand supply source into a funnel-hopper. In a second modality, frac liquid is received at the well site and stored in bilateral bladders within a central chamber. An in situ elongated longitudinal linear valve disposed within the hopper effectuates industry standard pressurized discharge of stored frac sand or discharge of frac liquid.

3 Claims, 15 Drawing Sheets

| Transportation Cost of 1 Frac Crew per Month | Conventional System | Barge/Container System |
|---|---|---|
| Number of Jobs 1 Frac Crew Can Do in 1 Month | 4 | 4 |
| Average Weight of Sand per Job (lb) | 3,750,000 | 3,750,000 |
| Required Sand (lb/Month) | 15,000,000 | 15,000,000 |
| Required Sand (Tons/Month) | 7,500 | 7,500 |
| Freight Cost ($/Ton) | 50 | 40 |
| Railroad Freight Cost ($/Month) | 375,000 | |
| Barge Freight Cost ($/Month) | | 300,000 |
| Railcar Capacity (lb/Car) | 200,000 | |
| Barge Capacity ($/Barge) | | 3,000,000 |
| Number of Required Hopper Cars per Month | 75 | |
| Number of Required Barges per Month | | 5 |
| Container Capacity (lb/Container) | | 50,000 |
| Number of Required Containers per Month | | 60 |
| Effective number of Leased Containers per Month | | 80 |
| Transportation Time (Days/Cycle) | 21 | |
| Demurrage Time (Days/Cycle) | 14 | |
| Effective number of Hopper Cars Required per Month | 47 | |
| Demurrage Fee ($/Car/Day) | 50 | |
| Demurrage Fee ($/Month) | 32,900 | |
| Hopper Car Offloading Cost ($/Car) | 500 | |
| Hopper Car Offloading Cost ($/Month) | 37,500 | |
| Barge Offloading Stevedore Services | | 4 |
| Barge Offloading Cost/Month | | 30,900 |
| Barge Dock Lease ($/Month) | | 4,000 |
| Port Fees ($/Ton) | | 0.50 |
| Port Fees ($/Month) | | 3,750 |
| Number of Loaded Container Handlers Required | | 2 |
| Loaded Container Handler Lease Cost ($/Month/Handler) | | 0 |
| Loaded Container Handler Lease Cost ($/Month) | | 0 |
| Number of Employees to Load/Offload Containers | | 3 |
| Monthly Wage ($/Employee) | | 3,000 |
| Container Loading/Offloading Labor Expenses ($/Month) | | 6,000 |
| 75 Ton Crane Rental | | 0 |
| Yard Spotter Rental | | 1,500 |
| Hopper Car Lease Cost ($/Car/Month) | 500 | |
| Container Lease Cost ($/Container/Month) | | |
| Container Lease Cost ($/Month) | | 0 |
| Hopper Car Lease Cost ($/Month) | 23,500 | |
| Capacity of Truck (lb) | 50,000 | 50,000 |
| Number of Truckloads Needed to Deliver Sand | 300 | 300 |
| Roundtrip Flat Rate Delivery Cost ($/Truckload) | 1,000 | 1,000 |
| Distance Differential Cost ($/hr) | | 0 |
| Distance Differential (hr/Month) | | 0 |
| Distance Differential ($/Month) | | 0 |
| Trucking Cost ($/Month) | 300,000 | 210,000 |
| Trucking Wait Time at Rig (hr) | 2 | 0 |
| Hourly Cost of Wait Time ($/hr) | 70 | 50 |
| Truck Wait Time Cost ($/Month) | 42,000 | 0 |
| Trucking Cost for Material Handling Equipment ($/Month) | | 8,000 |
| Overweight Permit ($/Month/Truck) | | 400 |
| Number of Trucks Requiring Permits | | 6 |
| Permit Cost ($/Month) | | 2,400 |
| Number of Trailers Required | | |
| Trailer Lease Cost ($/Trailer/Month) | | 0 |
| Trailer Lease Cost ($/Month) | | 0 |
| TOTAL COST | 810,900 | 566,550 |

FIG. 8

DUAL MODALITY CONTAINER FOR STORING AND TRANSPORTING FRAC SAND AND FRAC LIQUID

RELATED APPLICATIONS

This application is a continuation-in-part of U.S. Nonprovisional application Ser. No. 13/342,107 filed Jan. 1, 2012 which claimed priority based upon U.S. Provisional Application Ser. No. 61/429,046 filed Dec. 31, 2010. The disclosures recited in these related applications are incorporated herein by reference.

FIELD OF THE INVENTION

The present invention pertains to apparatus for handling frac sand and concomitant proppant, and frac liquids, and more particularly pertains to a container comprising a cross-brace framework, comparable to the cross-brace framework applicable to supporting a conventional ISO intermodal container adapted for temporarily storing frac sand and concomitant proppant obtained from a frac sand supplier's site, and transporting frac sand and proppant to a well site at which in situ hydrocarbon formation-fracturing operations will be effectuated; and for temporarily storing frac liquids comprising crude oil or water from fracking operations produced at the well site and transporting such liquids to a recycle facility for preparing suitable water to be injected downhole during subsequent fracking operations.

BACKGROUND OF THE INVENTION

In oilfield applications, pump assemblies are commonly invoked for pumping fluids at high pressures downward from the well surface downhole to a wellbore. Such oilfield operations frequently involve hydraulic fracturing. For hydraulic fracturing, abbreviated "fracking" herein for convenience, typically huge volumes of water and millions of pounds of abrasive-containing fluid such as sand and other primarily abrasive, solid crush-resistant particulate fracking materials Such primarily abrasive fracking materials are termed "proppant"; the combination of sand and concomitant proppant abrasive materials being termed "frac sand" herein. Frac sand and frac fluid, primarily comprising water, are pumped through the wellbore under extreme pressure and into targeted hydrocarbon reservoir regions proximal thereto, to create side "fractures" within the underlying hydrocarbon formations. As is well known in the art, in order to create such fractures, frac fluid containing abrasive proppant should preferably be pumped at extremely high pressures not only to facilitate fracture-creation, but also to sustain the propped-open subsurface structures. As will be appreciated by those skilled in the art, these propped-open structures afford additional pathways for hydrocarbon deposits to be urged to flow from underground formations to the well surface, thereby enhancing well production.

Prior art apparatus and methodology for transporting frac fluid containing frac sand suffer from several long-standing disadvantages. For instance, after being loaded onto either special-purpose pneumatic trucks or railcars, frac sand has typically not been well sealed from environmental incursions during transfers. As a consequence of such environmental incursions, the integrity of this frac sand has been seriously undermined whereupon significant degradation attributable to cumulative effects of abrasion and friction, and exposure to moisture and rain occur during material transfer operations. Since it has been difficult, if not virtually impossible, for a special-purpose railcar to be brought sufficiently close to well sites, prevalent contemporary practice has been for several material transfers to be prerequisite for ultimate delivery of an adequate quantity of frac sand to the intended well site so that fracking operations may be initiated.

Moreover, pneumatic trucks have frequently proven to be unavailable, thereby causing unloading of frac sand and the like from such special-purpose trucks or railcars to be likewise frequently delayed. It should be evident to those skilled in the art that a consequence of these multi-level delays is that railcars remain idle while substantial railroad demurrage fees accumulate. As, unfortunately, has become common in the art, under current fracking protocol, workers unavoidably are exposed to silica particles released during pneumatic transfer of frac sand. Another seemingly unavoidable disadvantage of the prior fracking art is that frac sand is frequently transferred from railcars to silos for storage. To achieve this sand storage capability at the transload facility, substantial capital costs of silos construction are incurred. According to the present invention, such sand storage silos and the like are rendered unnecessary because frac sand would preferably be stored in situ in the container framework hopper. Ergo, such containers can be stored and stacked on the ground independently of any associated railcars and pneumatic trucks—in the absence of silos.

Also well established in the fracking art is that once special-purpose trucks or railcars have transported frac sand to the prescribed well site at which fracking operations will occur, these trucks or railcars are returned empty to the point of origin to be reloaded and to effectuate another delivery of frac sand to the same or to another prescribed well site. Such a procedure obviously is not cost-effective and, on the contrary, is wasteful since substantial expense is incurred transporting these trucks or railcars that are devoid of any solid materials or liquid cargo.

Accordingly, what is needed in the art is an apparatus and associated methodology for improving logistics of transporting frac sand proximal to well sites to inherently avoid such several long-standing prior art limitations and disadvantages, and thus enabling temporarily storing and transporting of frac sand to well sites preferably via conventional flatbed truck trailers and conventional flatbed railcars, and for contemporaneously temporarily storing and transporting frac fluids, i.e., spent water and associated hydrocarbon liquids from the well site back to the frac sand supplier and/or back to a water recycle facility.

As will become clear to those skilled in the art, this need is fulfilled by embodiments of the present invention which contemplate novel application of suitably configured container frameworks, including, but not limited to, standard International Organization for Standardization ("ISO") shipping containers, constructed with internal structures for supporting and strengthening the internal walls and floor thereof, and a valve apparatus preferably configured to efficiently and securely achieve prerequisite frac sand transfer from such suitably configured container framework to well site fracking operations, regardless of the remoteness and limited accessibility of a diversity of well site locations.

It is an object and advantage of the present invention to provide a well-sealed temporary storage and transport container to inherently avoid environmental incursions thereinto which tends to undermine integrity of frac sand because of degradation attributable to cumulative effects of exposure to moisture and rain, and to abrasion and friction during material transfer.

It is an object of the present invention to avoid undue delay of transfer of frac sand from suppliers' facilities to well site locations due to unavailability of special purpose pneumatic trucks and railcars.

It is another object of the present invention to reduce hazardous exposure during fracking operations that threatens both workers and the environment.

It is yet another object and advantage of the present invention to provide a dual modality storage and transport container with simplified bladder valves enabling loading frac sand at a frac sand supplier's location, transferring and unloading such stored frac sand at the well site, and then enabling spent frac fluid comprising primarily flow-back water and associated small amounts of liquid hydrocarbons, to be loaded thereinto, and transported to a recycle water facility.

SUMMARY OF THE INVENTION

As will be hereinafter described in detail, the improvements to the prior frac storage and transport art contemplated by the present invention may be economically effectuated by either modifying a standard 20-foot ISO intermodal shipping container or by constructing anew a suitably configured and structured container framework. It should be understood by those skilled in the shipping art that container framework embodiments contemplated hereunder should be constructed to assure compliance with worldwide industrial and commercial standards similar to conventional ISO containers, and such shipping or freight containers should inherently provide reusable transport and storage units for moving products and raw materials between locations via conventional flatbed truck trailers and flatbed railcars, and the like.

More particularly, such storage and transportation apparatus should preferably be manufactured to substantially comply with ISO specifications, commonly identified by practitioners in the art as "ISO containers" typically sized with 20-foot length, with 8½-foot height and 8-foot width. Other reinforced frame dimensions, e.g., 6-foot height, may also be suitably constructed to enable dual modality frac sand and liquid storage and transport functions taught hereunder.

While it has been found to be economically advantageous to adapt standard ISO shipping containers to be suitable for frac sand transfer, and delivery thereof to well site locations, and for frac liquid transfer and delivery thereof from well site locations to water recycle locations, it should be clearly understood that embodiments of the present invention contemplated hereunder preferably comprise virtually any suitably-configured—preferably steel-reinforced—framework to perform prerequisite frac sand storage and transfer functions in an initial cycle, and then perform additional, heretofore unknown, frac liquid storage and transport functions in a subsequent, contemporaneous cycle as will be elucidated hereunder. It will be understood that such ample steel reinforcement is prerequisite to accommodate the formidable quantity and weight of abrasive frac sand materials typically stored and transported to well site locations, and fluid mixtures primarily of spent-water with associated small amounts of crude oil transported from the well site back to the origin of the frac sand supplier or to a water recycle facility—often occurring over rough terrain and under exigent environmental conditions. It has been found, for example, that shipping containers contemplated hereunder should preferably be filled only to about 50% of capacity in order to avoid exceeding its maximum strength while being transported via existing roads and existing railroad tracks.

Of course, any of a plethora of known bracing, crossbracing and truss designs may be implemented throughout a container frame's length in order to achieve the prerequisite wall strength and capacity contemplated herein. For instance, a horizontal and angular bracing framework may be invoked to reinforce container side walls, whether crimped or uncrimped, and to function as an adequate anchoring structure for supporting aluminum or steel plates that comprise a funnel-hopper member of a hopper discharge assembly as will be hereinafter described, especially suited to facilitate prerequisite angulation for achieving contemplated discharge of frac sand flowing from the hopper discharge assembly to support and enable downhole fracking operations.

Preferred embodiments of the present invention further comprise a central vertical support framework for anchoring the central section of this hopper discharge assembly, and for accommodating the requisite angulation for promoting adequate frac sand discharge. Embodiments of the hopper assembly comprise preferably four aluminum or steel-plate arm members and associated stiffening rod members, preferably angled at about 31° relative to the horizontal, functioning as a funnel-hopper member downwardly directing implicated frac sand into a discharge pipe.

As is known in the art, crimped steel structures enable support frameworks having a high strength-to-weight ratio. Nevertheless, container frameworks of sufficient strength contemplated herein may be constructed from crossbrace-and-truss embodiments as elucidated hereunder to support heavy frac sand loads via synergistic internal crossbracing structures and the like. Once a typically-sized 20-foot container has been suitably constructed with any underlying reinforcements as appropriate, an associated apparatus is needed for timely transferring the securely encased frac sand to an in situ high-pressure delivery system at a well site.

This frac sand transfer apparatus preferably comprises a hopper/valve assembly configured to deliver at the well site large volumes of frac sand through a plurality of ports built into the hopper/valve assembly. It will be seen that such abrasive fracking material is transferred mechanically through preferably a longitudinally-elongated hydraulic valve member devoid of particle acceleration and degradation. Thus, it will be readily understood that this advantageous particulate attribute tends to sustain higher average particle size and sphericity, in addition to more efficient frac sand downhole delivery than what has heretofore been practicable in the art.

After an embodiment of the present invention has discharged through its hopper/valve assembly the stored charge of frac sand, then preferably frac liquids, e.g., crude hydrocarbon liquid or spent, flow-back water would be loaded into a bladder assembly integrated within the hopper/valve assembly. This frac liquid would be transported to a quarry or a suitable site to be recycled for use during a subsequent fracking operation. It will be readily appreciated that the integration of such bladder member pair with the hopper/valve assembly that facilitates transporting frac liquids from fracking sites to recycle sites eliminates empty legs commonly occurring when trucks or railcars return after delivering frac sand to prescribed well site locations. Such a return trip for hauling crude or flow-back water results in substantial cost savings. Moreover, it will become clear that the dual modality taught under the present invention enables a substantial reduction in the number of delivery cycles necessary to complete and frac a well.

Consequently, the instant dual modality methodology teaches several advantages including substantial cost savings, reduction in carbon footprint at a well site, and even less wear and tear on implicated access roads essential to well site ingress and egress. It will be appreciated that the container crossbrace framework taught hereunder could be left at a well site for later use, e.g., be emplaced on the ground while trucks or railcars would simultaneously be released to accomplish other tasks. Thus, it will become evident that this novel dual modality protocol markedly reduces delivery vehicle downtime and eliminates the long-standing problem of flatbed trucks and the like unavoidably incurring protracted idling during typically long unload waiting times.

It will become evident to those skilled in the art that preferred embodiments hereof incorporate a structure comprising four primary components. A first component is a horizontal and angular peripheral bracing framework that strengthens the side walls of a container framework contemplated herein either constructed anew or adapted from an standard ISO intermodal shipping container, and serves as an adequate anchoring structure for supporting a plurality of preferably aluminum or crimped steel plates that comprise a funnel member of the associated hopper discharge member, and, in turn, thereby creates adequate angulation for achieving prerequisite downward discharge of frac sand from the hopper discharge member prerequisite for enabling downhole fracking operations.

A second component is a central vertical support framework that anchors the central section of the hopper storage and discharge assembly to the container floor for facilitating the hopper side plate arm members' angulation prerequisite for obtaining contemplated downward frac sand flow. This central rectangular anchor further preferably comprises a hydraulic valve member affixed thereto that controls loading into and discharge from the container hopper member. It will be seen that the instant hydraulic valve is emplaced adjacent a window situated on the container side near its base.

A third component of the preferred embodiment corresponds to the hopper assembly comprising preferably crimped aluminum or crimped steel plate arm members—preferably angled upwards 31° from the horizontal. As will be appreciated by those skilled in the frac sand art, 31° is preferable since it corresponds to the angle of repose. The hopper assembly plate arm members function as a funnel-hopper member downwardly directing implicated frac sand under the influence of an elongated linear discharge valve. A conventional hydraulic cylinder is preferably attached to this valve at a window member when the instant dual modality container is positioned to unload. More particularly, it will be understood that the piston of the hydraulic valve attaches to the elongated inner tube affording it the capability to move about 3" in either direction and, in so doing, either aligning or misaligning corresponding plurality of holes in each of the inner substantially square elongated tube and outer substantially square elongated tube, thereby being functionally related to the elongated linear valve's opening or closing. Thus, it should be appreciated that the inner elongated square tube and its corresponding outer elongated square tube are disposed in an annular relationship, with the inner tube capable of limited sliding within the stationary outer tube. It should be evident to those skilled in the art that when this elongated linear valve is open, the frac sand is expeditiously unloaded typically onto a conveyor or the like, whereupon the frac sand is appropriately positioned to be caused to flow downhole into the formation to be fracked along with high-pressure water.

A fourth component is an integrated bilateral bladder system for accommodating storage and transport alternatively of frac sand or frac liquid. While frac sand, as contemplated hereunder, comprises abrasive sand and proppant materials, frac liquid is contemplated as comprising liquid hydrocarbons or spent water which is typically admixed with minor amounts of crude hydrocarbons. As will be understood by those skilled in the art, when the bilateral bladder members are deflated, the pair of hopper arm members or hopper plate arm members are hydraulically urged to be disposed substantially in a relative horizontal position, i.e., angled at about 30° relative to the container floor, wherein the hopper member is configured in frac sand transportation mode to receive and store its charge of frac sand and transport this stored frac sand to a designated well site for unloading. On the other hand, for receiving, storing and transporting spent frac water or liquid hydrocarbons, the pair of hopper arm members or hopper plate arm members are caused to rotate to a substantially relative vertical position, i.e., angled at about 85° relative to the container floor, thereby enabling the bilateral bladder members to become fraught with such spent frac water or liquid hydrocarbons—filling the void created when all of the previously stored frac sand has been discharged at the prescribed well site. It should be understood that embodiments hereof may also be applied to not only transport frac sand or frac liquid from a transload facility to a producing well site, but also to transport frac water or crude oil and/or other hydrocarbons from a producing well site back to the transload facility or to a recycle facility.

The plurality of plate arm members taught hereunder are normally disposed in this locked "horizontal" position which, as contemplated hereunder as a sand modality enables adequate frac sand downward outbound flow, manifest essentially at about 30° relative to the flat bottomed base of the instant dual modality container. It will be appreciated by those skilled in the art that this approximate 30° plate arm member position affords the preferred configuration for loading frac sand into the hopper assembly described herein. It will be seen that, during this sand modality, the bilateral bladder member embodiments are deflated and positioned in the space below the plate arm members. As contemplated hereunder, the bilateral elongated bladder members are preferably constructed with dimensions of about 18 feet long, about 7 feet high, and about 3.3 feet wide—preferably comprising high-density, firm elastomeric material similar to material incorporated into military fuel storage containers or the like. As will be hereinafter described, under the influence of a likewise elongated linear hydraulic valve apparatus that controls the horizontal or vertical orientation of implicated hopper arms, the central hopper member is configured to hold frac sand, and the instant associated bilateral bladder members are disposed to be inflated in order to contain frac liquids when frac sand has been discharged and to transport such frac liquids when transportation vehicles would otherwise be returned empty, i.e., return devoid of any load. As will be understood by those conversant in the fracking art, an important aspect of the instant transfer apparatus embodiments is to inherently control frac sand discharge flow rate, and to simultaneously assure that such stored frac sand is completely sealed from environmental intrusion. Then, this transported frac sand must be properly discharged wherein an embodiment of the instant container is emptied at a well site nominally in about 15 minutes or preferably even less.

Those conversant in the art will comprehend that mere gravity-feed of this frac sand results in flow rates inadequate for performing the unloading and delivery thereof prerequisite for conventional fracturing operations at the well site. Embodiments of the present invention invoke a simple and straightforward valve member for achieving prerequisite sand material transfer in typically no less than industry-standard time. More particularly, the instant valve member comprises double tubular steel preferably disposed in a rectangular annular configuration. As will be readily appreciated by those skilled in the art, this valve member modus operandi simply slides the inner rectangular tube within the outer rectangular tube, nominally about 3 inches in either direction, with each tube having similarly-sized plurality of holes affixed thereupon. When this annular tubular arrangement is disposed with respective plurality of holes aligned, outbound frac sand flow is actuated wherein frac sand is unloaded through this elongated linear valve typically onto a conveyor or the like.

It should be evident that the plate or arm members of the preferred embodiments remain in this 30° relatively horizontal configuration until the frac liquid modality is triggered wherein the bilateral bladder members become inflated with either frac water or crude oil and implicated hydrocarbons. As will become apparent, the pair of arm members are hydraulically urged to pivot from this 30° (horizontal) position to a 85° (vertical) position to achieve its unique frac liquid modality, so that the respective plate arm members are no longer inhibiting or delimiting the upward inflation of the bilateral bladder members.

In the frac sand modality herein described, when the instant plurality of respective holes are not aligned, contemplated to be nominally only about an inch clearance on either side, frac sand is stored with the central chamber of the hopper-funnel assembly. On the other hand, when this respective plurality of holes is hydraulically urged to become aligned, frac sand is discharged apace via the funnel member of the hopper assembly. It will be understood that, in the other, frac liquid modality, the bilateral bladder members become fraught with frac liquid as herein described. It should be evident to those conversant in the art that the bilateral bladder members become inflated under the influence of the respective quick-connect inflow valves, and consequently their related hydrostatic pressure rises proportionately urging the plate arms to be lifted to about 85° relative to the container base or floor. In the preferred embodiment, a detent member, e.g., a 2"×6" block situated along the top edge of each plate arm member, has been found to effectively prevent the arm members from reaching 90° vertical position to sustain sufficient clearance between the bilateral bladder members. Of course, any of a variety of such basic detent members known in the art would suffice to delimit the upward rotation of the plate arm members to about 85°. It will be appreciated that, as the bladder members become deflated, these plate arm members return to the normal locked 30° position, whereupon the plate arm members' weight tends to assist discharging frac liquid from therewithin.

A feature and advantage of preferred embodiments of the present invention heretofore unknown in the frac sand art is inherently providing a dual modality apparatus that affords a first modality for transporting frac sand materials to the well site and, alternatively, affords a second modality for transporting frac liquids offsite from the well site to a recycle facility or the like. Thus, unlike the prior art, embodiments of the present dual modality invention inherently assure that there is no time that transportation vehicles are devoid of the ability to load, transport and unload either frac sand or frac liquid. It will become readily apparent that preferred embodiments hereof are configured with a dual modality wherein a first modality enables frac sand to be delivered to the well site, and wherein a second modality enables frac liquids to be transferred from production storage tanks adjacent a well site back to the frac sand supplier's quarry or like location, or to a location for frac water recycle. It should be understood that frac liquids transferred hereunder may constitute spent water typically including small amounts of liquid hydrocarbons, e.g., including about 2% hydrocarbons, or crude oil comprising implicated hydrocarbons.

More particularly, in one internal hopper modality, the preferred embodiment would be suitably configured with its bladder members deflated to enable frac sand to be store and then to effectively discharge this frac sand at the well site to support fracking operations. On the other hand, in a second internal bladder modality, the preferred embodiment would be configured with its bladder members inflated to receive inflowing frac liquids, i.e., crude oil or frac water consisting primarily of spent water and residual hydrocarbons. Contrary to the teachings of the prior art, bereft of such a dual modality protocol, embodiments hereof apply this instant in situ dual modality-functionality to seamlessly accomplish storage, transport and discharge of either frac sand or frac liquid within the same container framework as elucidated herein.

These and other objects of the present invention will become apparent from the following specification and accompanying drawings, wherein like numerals refer to like components.

BRIEF DESCRIPTION OF THE DRAWINGS

FIG. 8 depicts a spreadsheet tabulating a comparative analysis of frac sand delivery according to prior art conventional hopper apparatus and concomitant methodology vis a vis apparatus and concomitant methodology according to embodiments of the present invention.

DETAILED DESCRIPTION OF THE INVENTION

Embodiments of the present invention comprise a reinforced crossbeam container framework specially configured for frac sand temporary storage and transport. More particularly, as will become evident to those skilled in the art, embodiments of the instant frac sand transport apparatus are configured to enable each of its plurality of intake ports and similar plurality of discharge ports to be conveniently coupled with preexisting conventional input channels and output channels located in situ not only at the processing facility where frac sand is produced, but also at well sites where fracking operations are being conducted.

Figure 1:
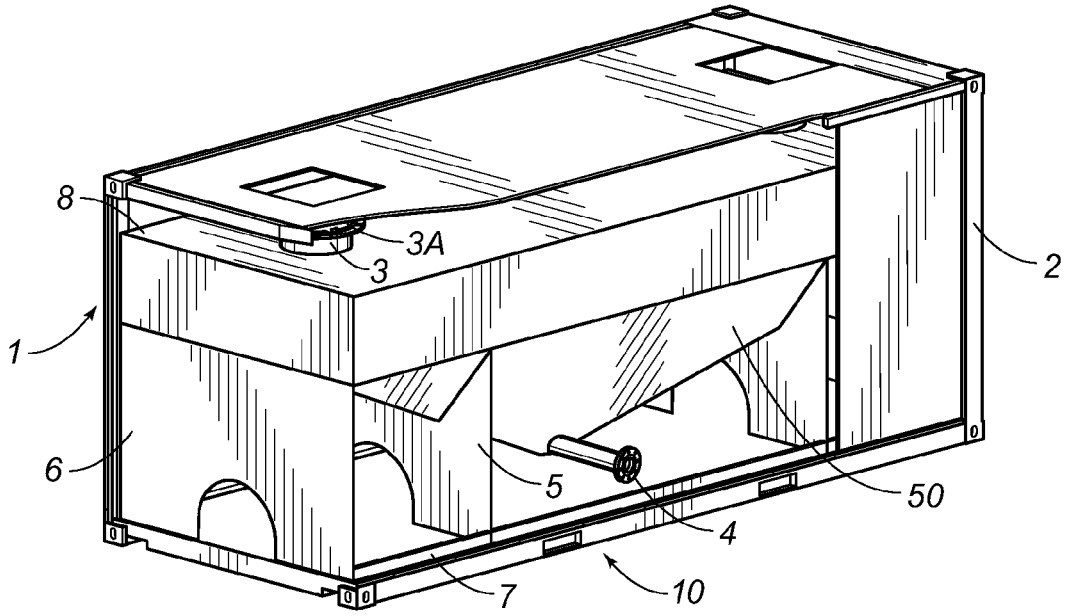
FIG. 1 depicts a simplified frontal perspective view of a dual modality frac sand container of the preferred embodiment of the present invention.
Figure 2:
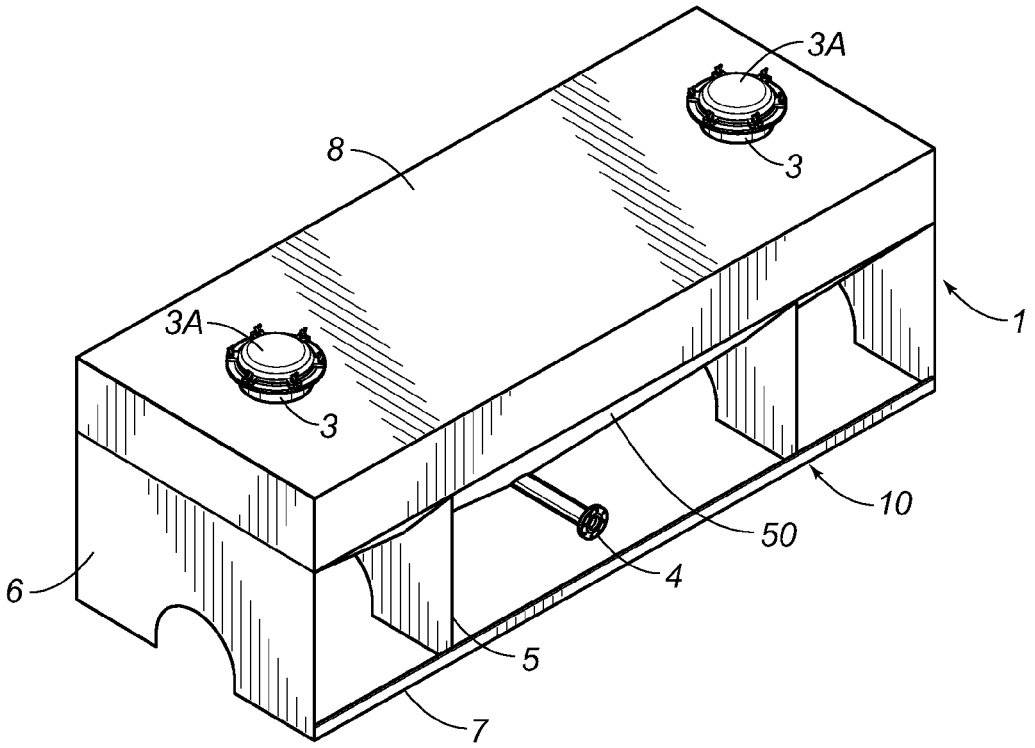
FIG. 2 depicts another simplified frontal perspective view of dual modality frac sand container depicted in FIG. 1.

Referring collectively to FIGS. 1-6, there is depicted a preferred embodiment 1 of an apparatus for transporting frac sand in a container 2 (only partially shown). More particularly, FIG. 1 depicts a perspective frontal view and FIG. 2 depicts an isometric side view, respectively, of frac sand transport apparatus 1, comprising plurality of inlet ports 3, plurality of outlet transverse discharge ports 4, plurality of saddle supports 5, pair of end supports 6, pair of cross-braces 7, and roof 8.

Figure 3:
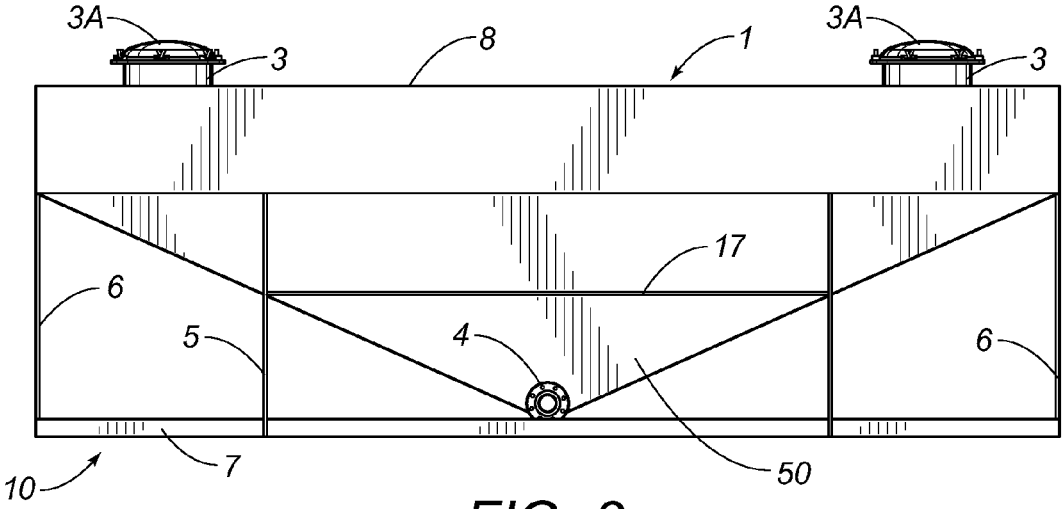
FIG. 3 depicts a front view of the embodiment depicted in FIGS. 1 and 2.

As can be seen from FIGS. 1-3, the external framework of frac sand transport apparatus 1 adapted to afford prerequisite strength and support for accommodating the contemplated frac sand material loads, comprises brace and truss support assembly 10. More particularly, this brace and truss support assembly comprises each of pair of longitudinal basal crossbraces 7 fixedly interconnected at each end thereof with one of pair of end supports 6 and intermediately thereof with plurality of saddle supports 5. While base of apparatus 1 structurally devolves to a framework anchored by the fixed interconnection of pair of basal crossbraces 7 and pair of end supports 6 reinforced medially by plurality of saddle supports 5, the upper portion thereof is secured by roof 8. It will also be seen that the structure of frac sand transport apparatus 1 is further secured by medial crossbrace 17 which is affixed to the plurality of saddle supports 5. It should be clearly understood, however, that any of a plethora of similarly situated support assemblies may be invoked and be consistent with the teachings of the present invention, so long as sufficient strength and support is provided for reinforcing strength and support of the implicated framework of storage and transport containers as contemplated hereunder.

Figure 4:
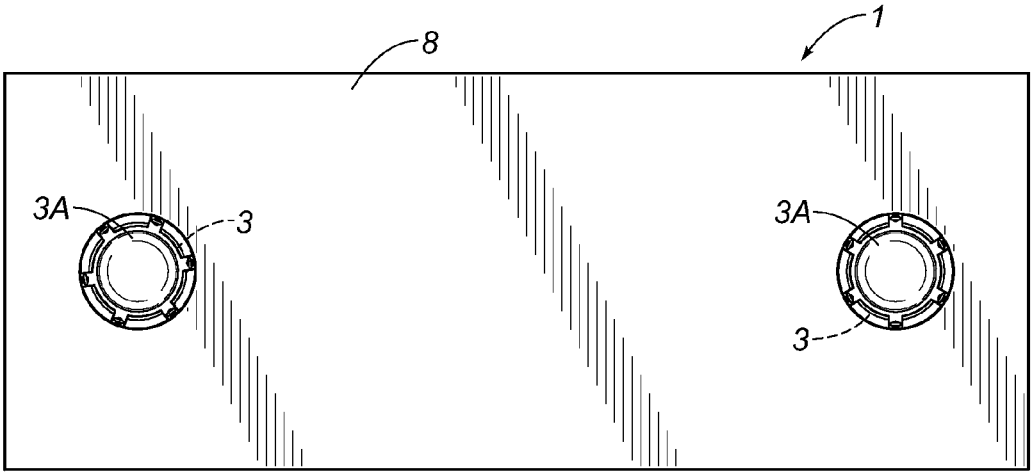
FIG. 4 depicts a top planar view of the embodiment depicted in FIG. 2.
Figure 5:
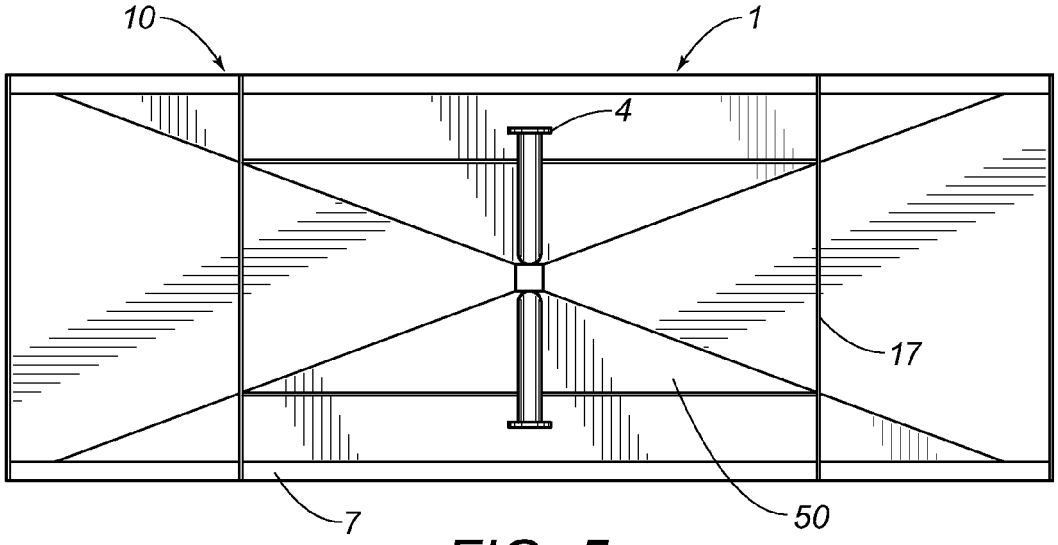
FIG. 5 depicts a bottom view of the embodiment depicted in FIGS. 1-4.
Figure 6:
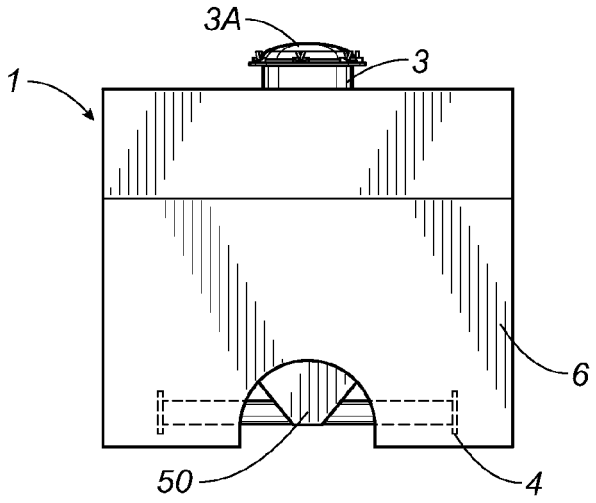
FIG. 6 depicts a right side or end view of the embodiment depicted in FIGS. 1-4.

Referring collectively to FIGS. 3 and 4, there is depicted embodiment 1 of an apparatus for transporting frac sand in transport container 2 (only partially shown). FIG. 3 depicts a perspective view and FIG. 4 depicts an isometric view, respectively, of frac sand transport apparatus 1, comprising plurality of inlet ports 3, plurality of outlet transverse discharge ports 4, and internal bracing structure 10 comprising plurality of saddle supports 5, pair of end supports 6, pair of cross-braces 7, and roof 8.

As can be readily seen, the external framework of frac sand transport apparatus 1 affording prerequisite strength and support for accommodating contemplated frac sand material loads, comprises brace and truss support assembly 10. More particularly, this brace and truss support assembly comprises each of pair of longitudinal basal crossbraces 7 fixedly interconnected at each end thereof with one of pair of end supports 6 and further intermediately interconnected with plurality of saddle supports 5. While base of apparatus 1 structurally devolves to a framework anchored by fixed interconnection of pair of basal crossbraces 7 and pair of end supports 6, reinforced medially by plurality of saddle supports 5, the upper portion thereof is secured by roof 8.

It should be clearly understood, however, that any of a plethora of similarly situated internal supporting framework assemblies may be invoked and would be consistent with the teachings of the present invention, so long as sufficient strength and support are provided for accommodating frac sand loads contemplated hereunder. For instance, while several variations of essentially all-steel plate-truss-brace embodiments have been crafted, these embodiments have suffered from the disadvantage of being unduly heavyweight. In order to optimize use of the inherent strength of the container's walls and to reduce fabrication time, a combination of trusses and C-Purlins have been implemented for providing steel plate support. As will be understood by those skilled in the art, this C-Purlin protocol not only tends to afford superior container wall strength, but also tends to transfer the weight of the load to the floor.

Accordingly, when situated at a frac sand supplier venue, a preferred embodiment hereof would inherently invoke its frac sand modality whereupon it would be configured to receive a prescribed load of frac sand into its hopper/valve infrastructure and then proceed to be disposed upon a railway tankcar or flatbed truck for delivery to a designated well site at which fracking operations will be effectuated. When situated at a well site after unloading its charge of frac sand, a preferred embodiment hereof would inherently invoke its liquid modality whereupon it would be configured to receive a prescribed quantity of crude or other liquid hydrocarbon or flow-back spent water into its bladder infrastructure and then proceed to be disposed upon a railway tankcar or flatbed truck for delivery to a frac sand supplier's venue or other water recycle destination.

It will become evident to those skilled in the fracking art that embodiments of the present invention achieve efficient transient storage and transport of both frac sand and liquids in the form of crude and other hydrocarbons and spent, flow-back water, via its novel integrated dual modality infrastructure. Unknown in the art, in one internal modality of its dual bladder modality, the preferred embodiment would be configured to receive inflowing flow-back water along with admixed crude oil or other liquids associated with the fracking process through input ports. Contrary to the teachings of the prior art, it will become clear that this dual modality-functionality is seamlessly accomplished in situ by invoking a suitable framework, as illustrated and configured as elucidated herein. Indeed, preferred embodiments hereof effect a metamorphosis of the frac art because the logistics and safety associated with hydrocarbon fracking operations have been unexpectedly improved to such an extent that several long-standing problems and limitations of the prior art have been inherently eliminated.

Figure 9:
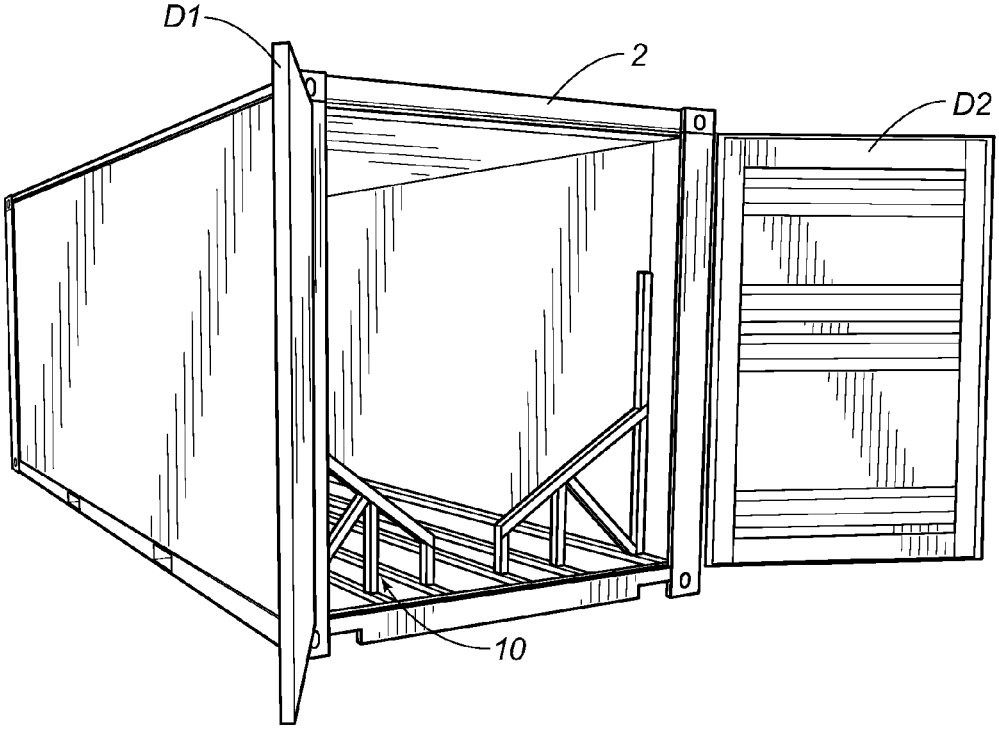
FIG. 9 depicts an end perspective view of the embodiment depicted in FIGS. 1-4, with its end-opening doors disposed in an open position.

Now focusing collectively upon FIGS. 9-15, there is depicted a portion of the contemplated in situ crossbrace and truss framework that affords reinforcing strength and support to the internal walls and the like of container 1, and simultaneously encloses the hopper assembly and associated valve apparatus embodiments of the present invention. As described herein, such valve apparatus may be mechanical or preferably hydraulic to effectuate industry standard outflow of frac sand material being held within the hopper assembly and container. Thus, FIG. 9 depicts an end perspective view of container 1 incorporated into embodiments of the present invention, with its end-opening doors D1 and D2 disposed in an open position. Also depicted therein, is a portion of brace and truss framework 10.

Figure 10:
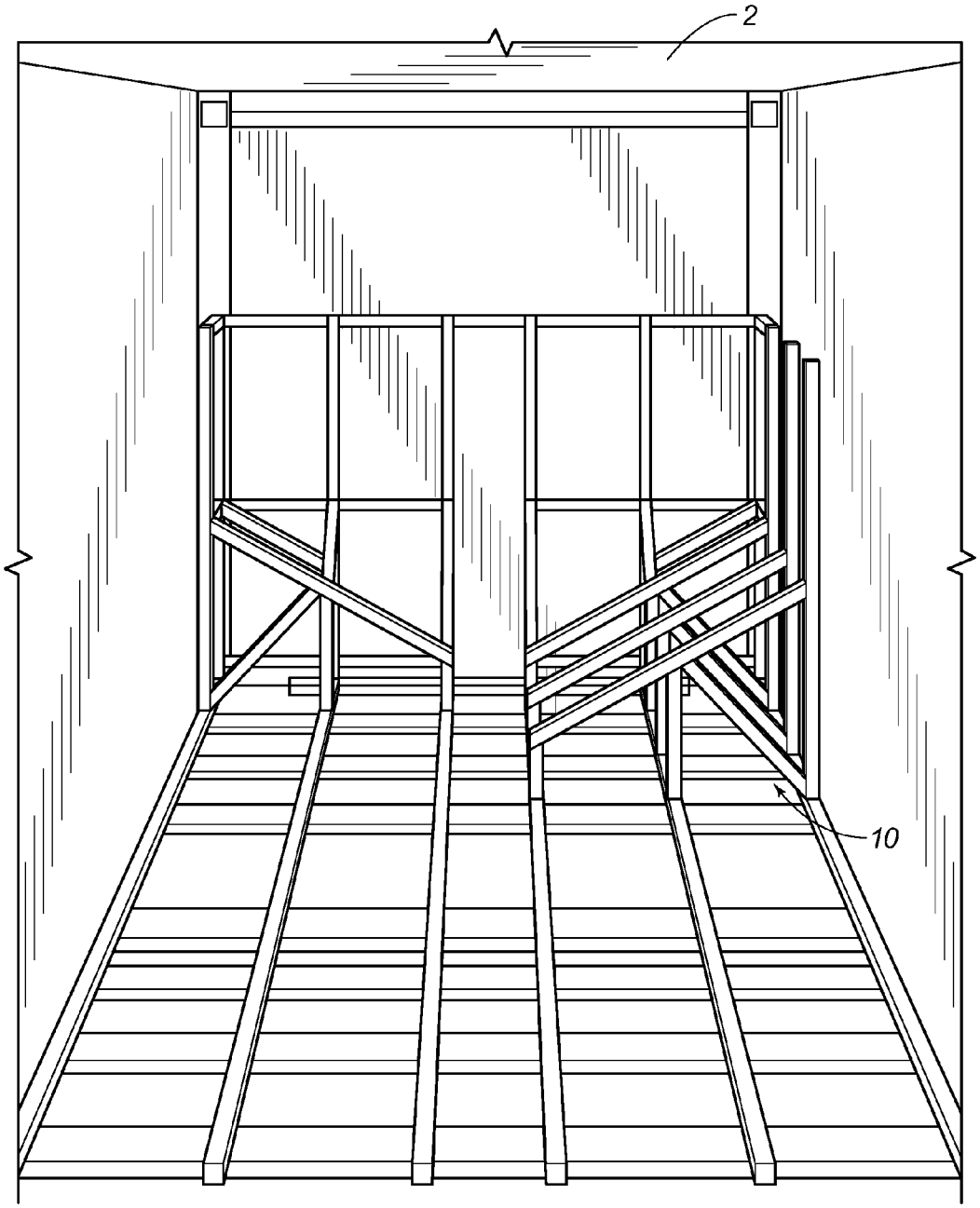
FIG. 10 depicts a frontal perspective view of a portion of internal brace and truss framework incorporated into a preferred embodiment of the present invention.
Figure 11:
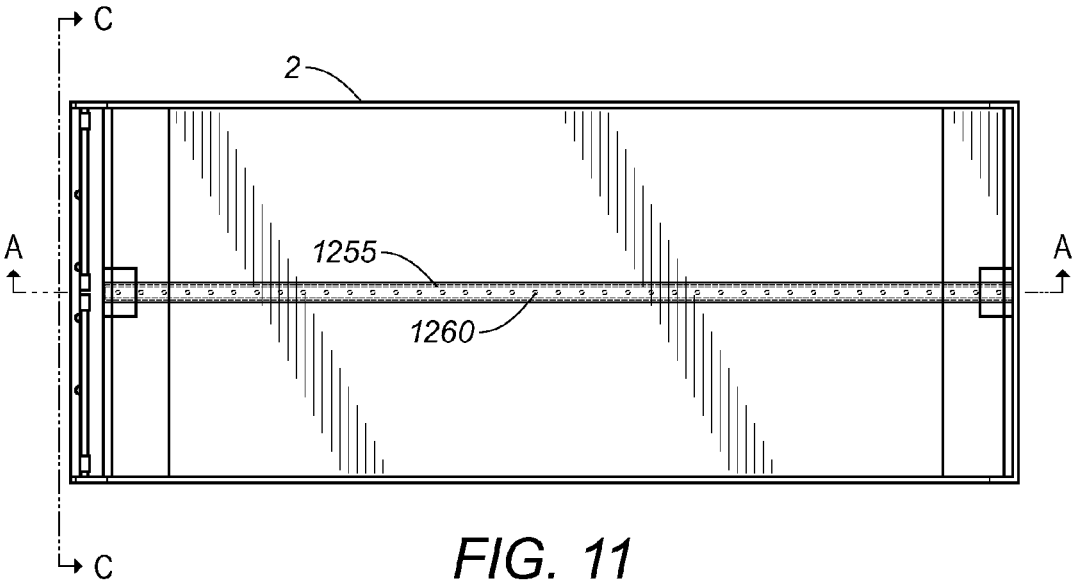
FIG. 11 depicts a plan view of the embodiment depicted in FIGS. 1-4 illustrating a plurality of holes upon pipe disposed longitudinally from one end of the embodiment to the other end thereof.
Figure 12:
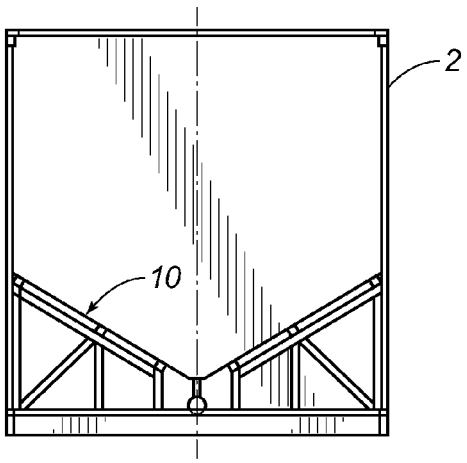
FIG. 12 depicts a cross-sectional view of the embodiment depicted in FIG. 11, along line C-C.
Figure 13:
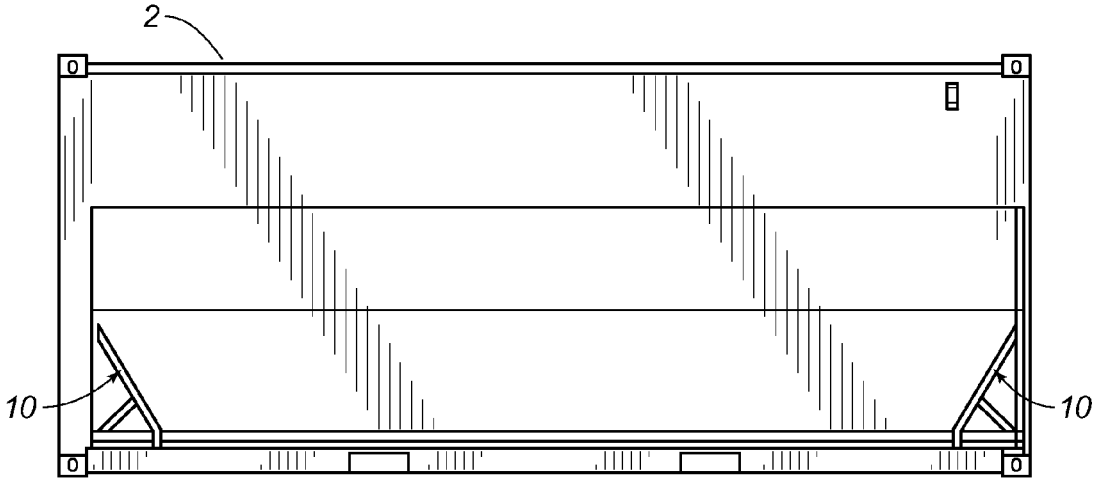
FIG. 13 depicts a sectional view of the embodiment depicted in FIG. 11, along center line A-A.

FIG. 10 depicts a frontal perspective view of another portion of internal bracing framework 10 incorporated into the container depicted in FIG. 9. FIG. 11 depicts a plan view of the container depicted in FIGS. 9 and 10. FIG. 12 depicts a cross-sectional view of the container depicted in FIGS. 9 and 10, and along line C-C in FIG. 11. FIG. 13 depicts a sectional view of the container depicted in FIGS. 9 and 10, and along center line A-A in FIG. 11.

Figure 14:
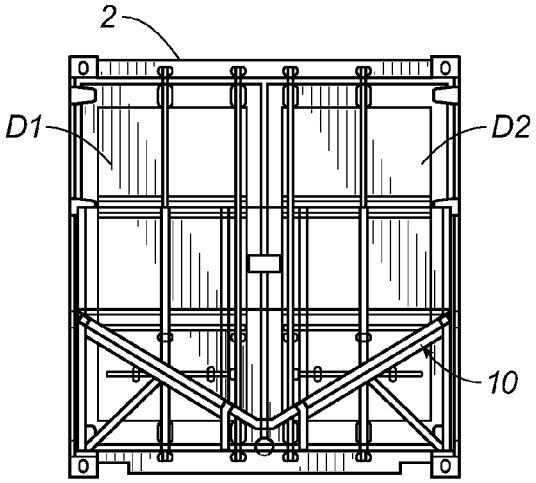
FIG. 14 depicts a door elevation end view of the embodiment depicted in FIGS. 9 and 10.
Figure 15:
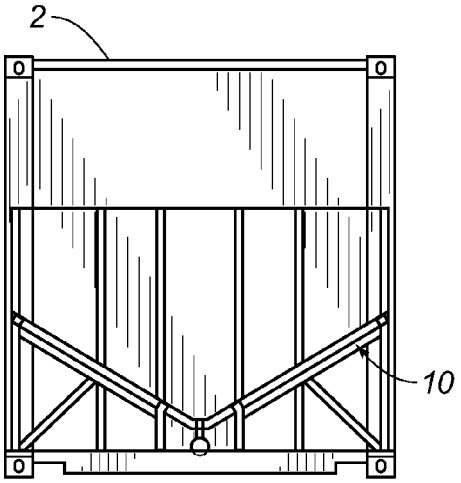
FIG. 15 depicts a rear elevation end view of the embodiment depicted in FIGS. 9 and 10.

FIG. 14 depicts a door elevation end view of the container depicted in FIGS. 9 and 10. FIG. 15 depicts a rear elevation end view of the container depicted in FIGS. 9 and 10. Embodiments of the present invention should preferably be structured to endure stress manifest throughout by a maximum of 50,000 pounds of frac sand material as the specially-constructed containers travel over rough terrain and the like, en route to well sites.

Referring again to FIGS. 1-6, there is seen a pair of tubular input ports 3 disposed atop roof 8, with each input port being secured and sealed with a cap or lid 3A as shown. It will be understood that these input ports are typically 20" manways having water-tight hinged lids that are conveniently manually removed via integrated wing-nuts. Also seen is transverse discharge port 4 with a mechanical valve or the like typically having a 4 inch outlet and a 24"×24" sliding gate valve.

It will be appreciated by practitioners conversant with handling conventional ISO containers and similar custom-build substantially rectangular containers that caps 3A situated atop the 20-inch manways 3 should preferably be situated flush atop such containers. Accordingly, the lids 3A would preferably be situated just beneath the container roof 8 and, once manually opened, frac sand would be delivered into the hopper portion of apparatus 1. To assure that contained frac sand remains devoid of water incursion, it is contemplated that the apparatus lid would be enclosed within a hingedly-opened cut-out or like recess.

It will also be appreciated that a 24"×24" gate valve or the like is particularly advantageous under circumstances in which frac sand is being unloaded into a mobile hopper unit or the like. But, it should be understood that, if such mobile hopper units are apt to be unloaded under the influence of a blower or the like through 4 inch piping, then use of such a gate valve would probably be unnecessary. Of course, those skilled in the art will readily appreciate that, if and when a gate valve were used in conjunction with an embodiment of the present invention, then frac sand would be unloaded or dumped into a dolly hopper or the like. Under such circumstances, the top of the dolly hopper should preferably be constructed from two thin-gauge sheet metal telescoping tubes in order to facilitate sliding thereunder and then being raised to meet the flange disposed on the bottom of the large hopper unit.

Figure 16A:
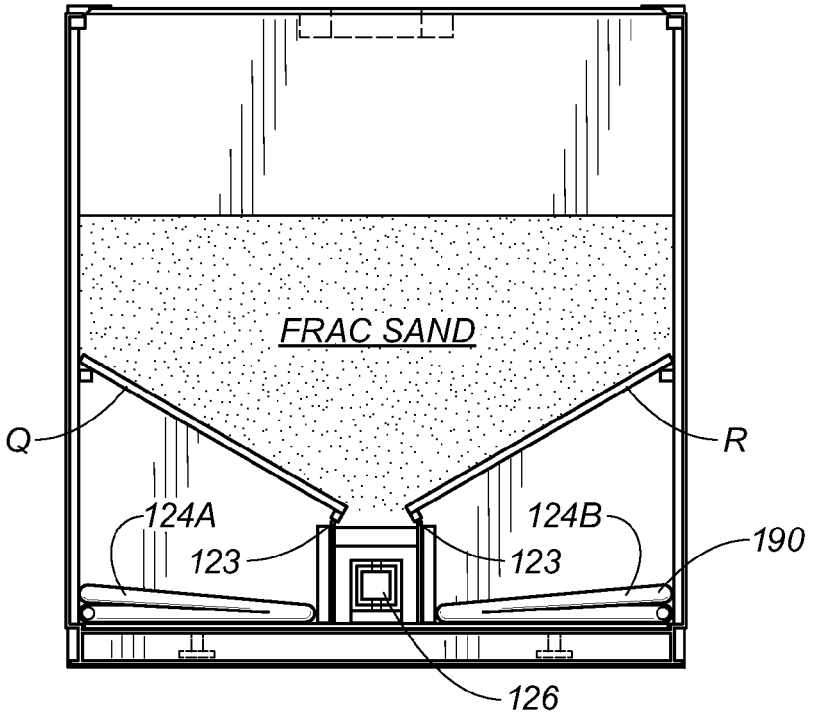
FIG. 16A depicts a preferred embodiment of the present invention disposed in a first, frac sand modality, with its pair of bladders deflated.
Figure 16B:
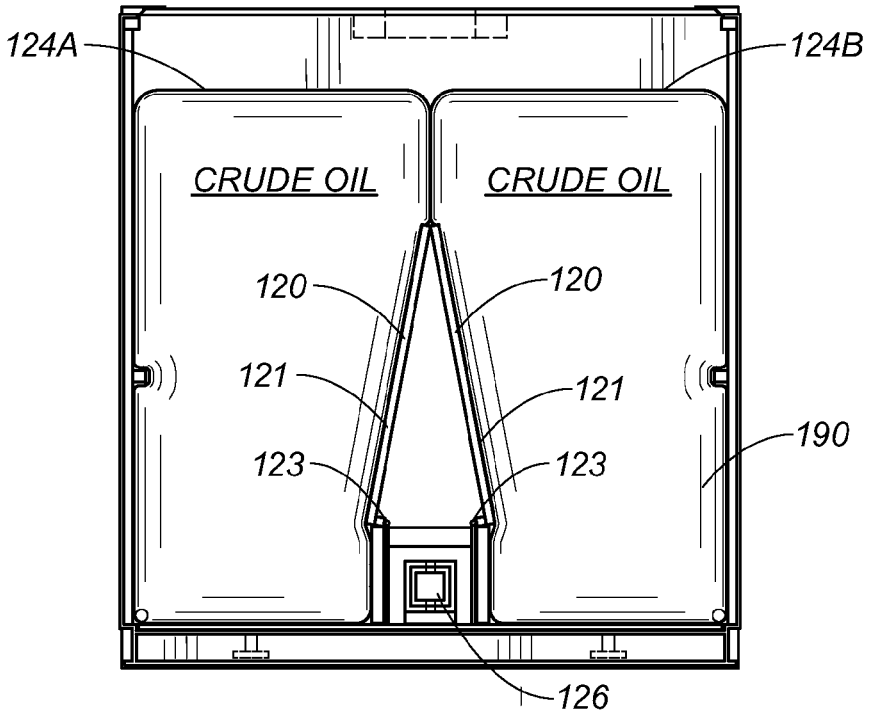
FIG. 16B depicts a preferred embodiment of the present invention disposed in a second, frac liquid modality, with its pair of bladders inflated.

Referring now to FIGS. 16A and 16B, there is depicted a simplified cut-away end view of the bladder assembly 190 taught by the preferred embodiment of the present invention. there is seen bladder member pair 124A and 124B that would be inflated at the well site with crude or other liquid hydrocarbon or spent, flow-back-water through a pipe connected at preferably quick connect-disconnect flange 200. Thus, contemplated bladder inflation would occur simultaneously by emplacing quick-connect fitting 200 on the external surface of framework container 1. During this inflation process, air or hydrocarbon vapors would preferably be vented to the atmosphere external to the container via a conventional air pressure relief valve disposed at each vent port 210A and 210B thereatop. These one-way relief valves allow hydrocarbon vapor and air to be vented while fluid filling occurs.

Pair of equalizer ports 220A and 220B disposed on the bottom of bladder assembly 190 equalize the amount and distribution of liquid between bilateral bladder members 124 and 124B. One of these two equalizer members is attached to the bottom of each bladder member and enables free flow of liquids therebetween to sustain uniform distribution of liquid material and to prevent onset of instability if one bladder loses all or a portion of its contents.

It will be understood by those skilled in the art that when instant bilateral bladder members are inflated to capacity, bladder assembly 190 is situated to enable the inflated bladder pair 124A-B to fill available space when pair of vertically-oriented hinge plate arm members Q and R are disposed medially relative to each other (as depicted in FIG. 8). Hinge member 126 controls synchronized rotational movement of plate arm members Q and R to either accommodate incoming frac sand in the first or sand modality or to accommodate incoming liquid in the second or liquid modality taught hereunder.

For the sand modality taught hereunder, frac sand enters container framework 1 via input port members 3 from thereatop while simultaneously plate arm members Q and R are synchronously gradually urged downward to ultimately be emplaced into a relatively horizontal-oriented disposition as shown in FIG. 16A. Contrariwise, for the liquid modality as taught herein, depicted in FIG. 16B, liquid enters container framework 1 via quick connect-disconnect input port member 200 from a side thereof while simultaneously plate arm members Q and R are synchronously gradually urged upward to ultimately be emplaced into a substantially vertical disposition at about 85° relative to the floor or container bottom. To sustain structural integrity of plate arm members Q and R preferred embodiments should preferably incorporate steel-reinforced container side wall members 120 and 121 laterally, and steel-retaining walls 123 on each end thereof.

It should be understood by those skilled in the art that, for the frac sand modality, hopper arm plate members Q and R are disposed substantially in a lateral 30° inclined position in FIG. 16A. Bladder members 124A and 124B are deflated, but may contain residual amounts of spent water and/or crude oil as a result of a previous frac fluid modality. Regardless, the deflated bladder members lie in a deflated state in the dead space disposed immediately beneath the pair of hopper plates. As will be appreciated by those conversant in the art, deflated bladder pair 124A-B require no additional support. It will also be appreciated that, when the bladders are caused to inflate, respective pair of hopper plate arm members Q and R rotate from a horizontally-oriented position to a vertically-oriented position. The bilateral bladder members are then supported by the adjacent infrastructure taught hereunder: medially by the vertical hopper plates; laterally by the respective suitably reinforced container walls; at one end by the closed container door pair; and at the other, opposite end by an end wall. As shown, bilateral bladder members 124A-B are attached to the container walls at two points to quick-connect flanges: one for inflow and the other for discharge.

It will be appreciated that 16 gauge flat steel enables the 30° angle of repose prerequisite for the contained frac sand to flow to the valve apparatus taught herein. In a manner known in the art, this flat plate is securably attached to a container side wall disposed thereabove, and the hydraulic valve therebelow.

Referring now to preferred bladder assembly 190 depicted in FIGS. 16A-B, there is seen bladder member pair 124A and 124B that would be inflated at the well site with crude or other liquid hydrocarbon or spent-water through a pipe connected at preferably quick connect-disconnect flange 200. Thus, contemplated bladder inflation would occur simultaneously by emplacing quick-connect fitting 200 on the external surface of framework container 1. During this inflation process, air or hydrocarbon vapors would preferably be vented to the atmosphere external to the container via a conventional air pressure relief valve disposed at each vent port 210A and 210B thereatop. These one-way relief valves allow hydrocarbon vapor and air to be vented while filling occurs.

Pair of equalizer ports 220A and 220B disposed on the bottom of bladder assembly 190 equalize the amount and distribution of liquid between pair of bladder members 124 and 124B. One of these two equalizer members is attached to the bottom of each bladder member and enables free flow of liquids therebetween to sustain uniform distribution of liquid material and to prevent onset of instability if one bladder loses all or a portion of its contents.

It will be understood by those skilled in the art that when this pair of bladder members is inflated to capacity, bladder assembly 190 is situated to enable the inflated bladder pair 124A-B to fill available space when pair of vertically-oriented hinge plate arm members Q and R are disposed medially relative to each other (as depicted in FIG. 8). Hinge member 126 controls synchronized rotational movement of plate arm members Q and R to either accommodate incoming frac sand in the first or sand modality or to accommodate incoming liquid in the second or liquid modality taught hereunder. Hence, for the sand modality, frac sand enters container framework 1 via input port members 3 from thereatop while simultaneously plate arm members Q and R are synchronously gradually urged downward to ultimately be emplaced into a horizontal disposition. Contrariwise, for the liquid modality as taught herein, liquid enters container framework 1 via quick connect-disconnect input port member 200 from a side thereof while simultaneously plate arm members Q and R are synchronously gradually urged upward to ultimately be emplaced into a vertical disposition. To sustain structural integrity of plate arm members Q and R preferred embodiments should preferably incorporate steel-reinforced container side wall members 120 and 121 laterally, and steel-retaining walls 123 on each end thereof.

It will be appreciated that embodiments of the present invention should preferably be structured to endure stress manifest throughout, wherein such stress could be imposed by a maximum of 50,000 pounds of frac sand material as specially-constructed containers 1 travel over rough terrain and the like, en route to well sites to facilitate fracking operations. It will be appreciated that doors D1 and D2 are sealed via gaskets disposed on adjacent sides of struts and the like in a manner well known in the art, to assure a closed system as contemplated hereunder.

Focusing on the cross-sectional view of the hopper plate and associated valve assembly of the present invention, there is seem reinforcing steel members that strengthen the container walls and floor to adequately support and enable contemplated operation of the hydraulic valve which controls movement and positioning of hinged steel plate arm members R and Q that are adapted to rotate in a vertical plane. Also shown are high-density durable inflatable bladder members 124A and 124B with concomitant intake and outflow valves, and an implicated internal manifold assembly. It will be readily understood that this internal manifold assembly interconnects with each of the pair of bladder members and assures that there will be uniform compression during discharge thereof, thereby allowing for and, indeed, accommodating a potential leak in one of such bladder members.

There is also depicted brake pressed/crimped steel plate 107 which comprises the walls of hopper 30. A Faztek 15 series heavy duty steel pivot hinge has been found to be a suitable component of the preferred embodiment; hinges should preferably be secured at optimum spacing along the length of the flange. It has been found that 3' spacing along the length of the flange achieves intended valving performance contemplated hereunder. It will be appreciated that the upper and lower leaf portions of the hinge should be bolted to the interior surfaces of the hopper arm plate members. Preferably, a sliding track rubber seal member 108 should be secured to the 15° beveled edge of the hopper plate members.

Figure 17:
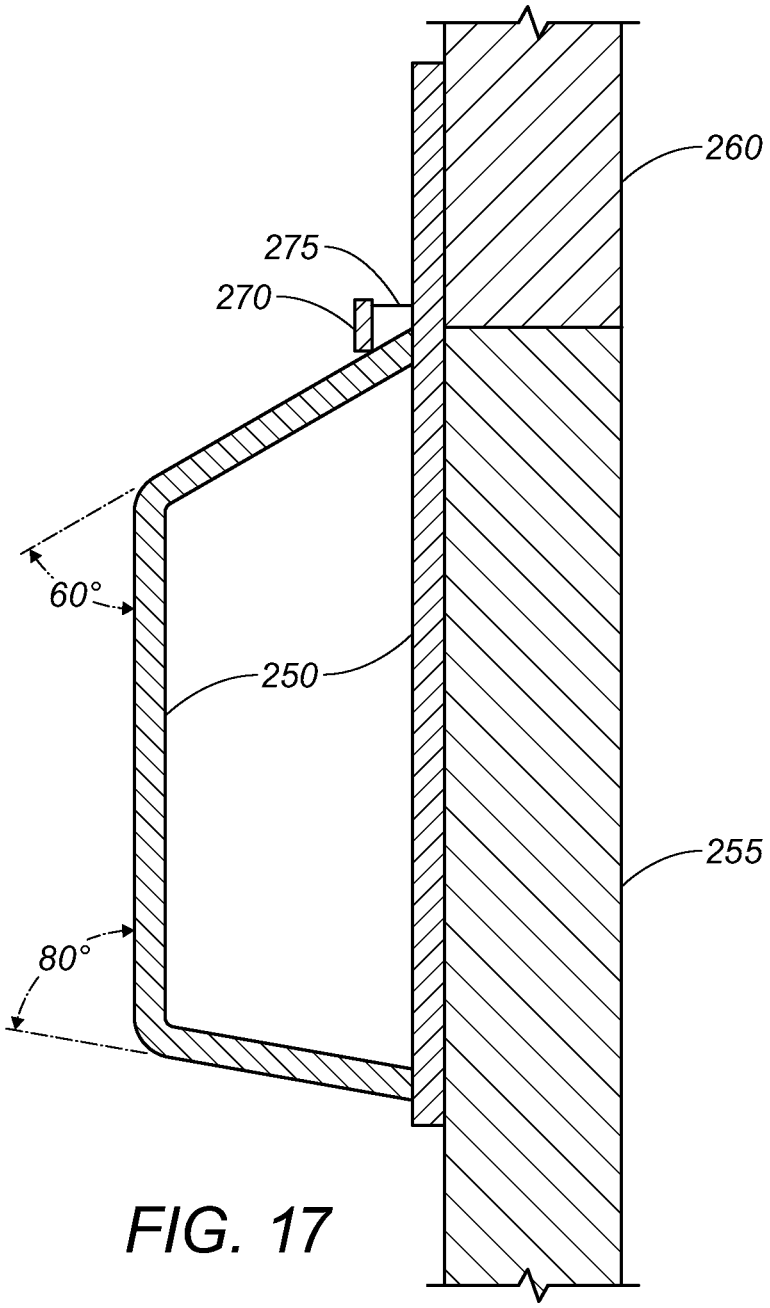
FIG. 17 depicts a cross-section view of hopper plate of funnel-hopper member of the preferred embodiment.

Now referring to FIG. 17, there is depicted the lateral interface of hopper plate 108 and concomitant bracing of the container sidewall 107. Lateral brace 250 is welded to a channel beam 255 which is, in turn, welded to each corrugation and the vertical support columns at each corner. Lateral brace member 250 should preferably be configured to sustain the maximum load of the hopper plates when fully loaded in the down, horizontally-oriented position. A locking lug member 270 engages the distal concavity of the plate corrugation and is sealed by adjacent closed cell foam 275 or the like. It will be appreciated by those skilled in the art that the distal portion of the hopper arm plate is supported by lug member 270 and underlying brace member 250. An additional portion of the lateral arm plate is supported by the upper limb of lateral brace member 250 matching the 30° angulation of the overlying plate. Lower limb of lateral brace member 250 is angulated superiorly 10° from the horizontal to maximize resistance to the load.

Figure 18:
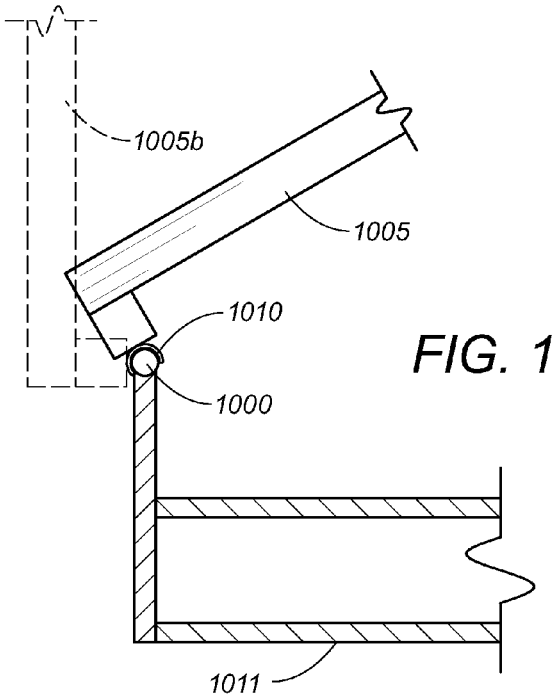
FIG. 18 depicts an isolated cut-away side view of a hopper hinge of the funnel-hopper member of the preferred embodiment.

Now referring specifically to FIG. 18, there is shown a cut-away side view of the right portion of the instant hopper hinge 1000. In the preferred embodiment, to assure contemplated continuous operation thereof, preferably three removable continuous retainer rings 1010 should be incorporated therein. Also depicted is folding hopper bottom member 1005 and its disposition when folded vertically 90°—shown as dotted lines as 1005*b*. It will be appreciated by those skilled in the art that this hopper hinge assembly should preferably be constructed with a C Purlin material base frame 1015.

Figure 19A:
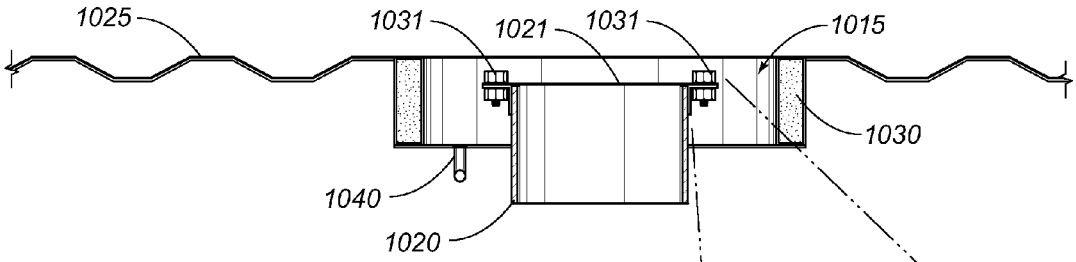
FIG. 19A depicts a partial cross-sectional view of a fill inlet of the preferred embodiment
Figure 19B:
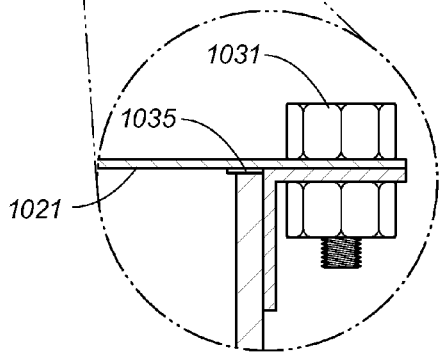
FIG. 19B depicts an exploded cross-sectional view of a portion of the fill inlet depicted in FIG. 19A.

Referring to FIGS. 19A-B, there are seen detail partial cross-sectional views of fill inlet 1015 relative to container top 1025. Fill inlet 1025 preferably comprises 12" pipe neck member 1020 within fill frame member 1030 and preferably ⅜" water drain outlet. It will be understood that contemplated drain water drainage is achieved by welding commensurate pipe flush to top of plate route line to exterior of side wall with a seal weld. Also depicted in exploded view 19B of one of pair of nuts 1031 securing fill cap 1021 with adjacent rubber gasket 1035.

Figure 21:
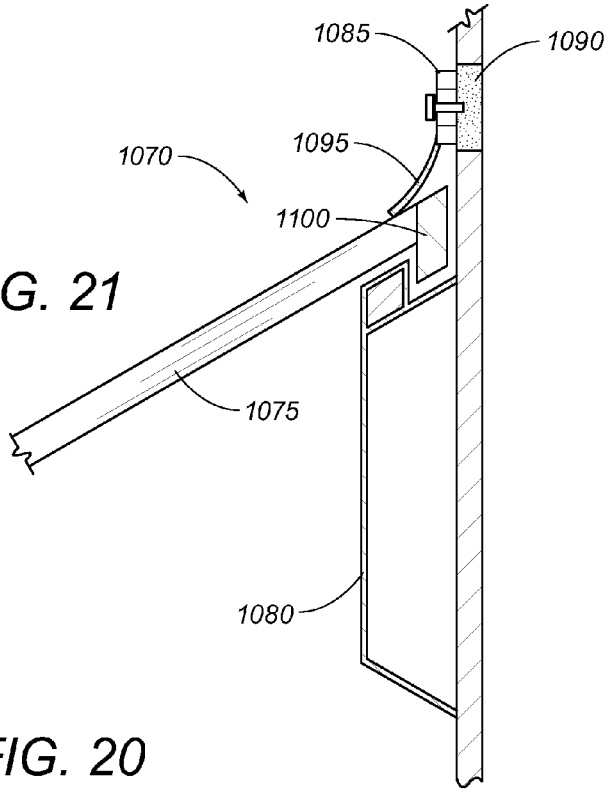
FIG. 21 depicts a cross-sectional view of sealed and reinforced container wall of the preferred embodiment.
Figure 20:
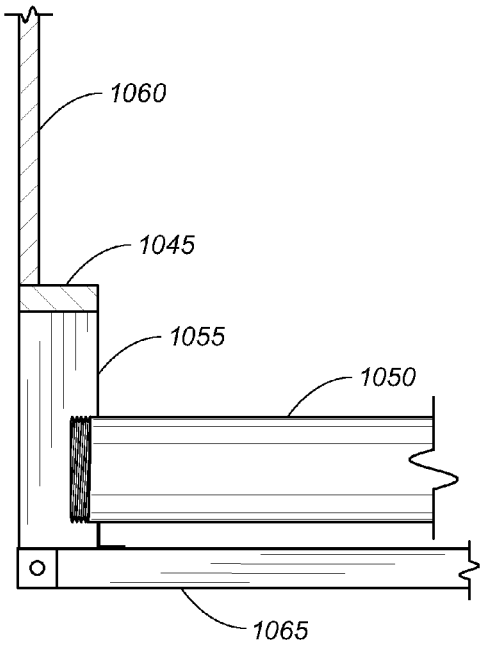
FIG. 20 depicts an isolated frontal view of outlet frame of the preferred embodiment.

FIG. 20 depicts outlet frame 1045 comprising outlet pipe threadedly attached to plate outlet diaphragm 1055 affixed to container floor 1066 and adjacent container wall 1060. It will be understood that outlet pipe 1050 should preferably be sloped back the container floor and be welded onto the hopper reinforced end. Now referring to FIG. 21 there is shown sealed and reinforced container wall 1170 comprising preferably ⅜"×2" steel 50 KSI flat bar block 1100, EDPM continuous flexible seal 1095, 2"×⅛" flat bar gasket removable over foam seal with securing foam gasket 1090. Also shown is hopper bay bottom preferably constructed from crimped steel 50 KSI steel for accommodating loads of about 500 pounds per square foot; preferably trapezoid configured channel frame wall diaphragm affords prerequisite reinforcement and frac sand seal.

Figure 22:
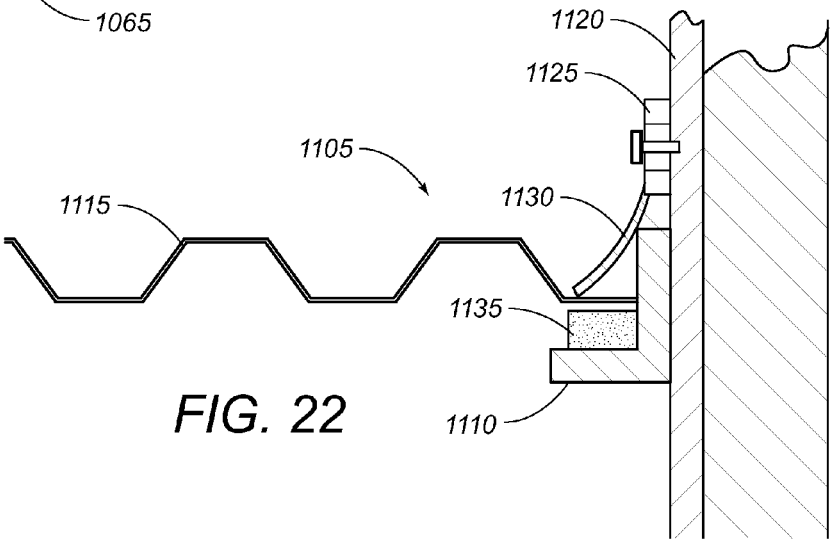
FIG. 22 depicts the hopper bottom end seal assembly of the preferred embodiment.

Referring now to FIG. 22, there is depicted the hopper bottom end seal assembly 1105 comprising preferably corrugated steel hopper bottom, EDPM continuous flexible seal 1130 affixed to preferably 2"×⅛" bar gasket frame 1125 removable over foam seal and affixed to 50 KSI ⅛" plate over HSS 2"×2"×3/16" end frame 1120; foam gasket 1135 adjacent 50 KSI 3"×3"×⅜" sloped end support 1110.

Figure 23:
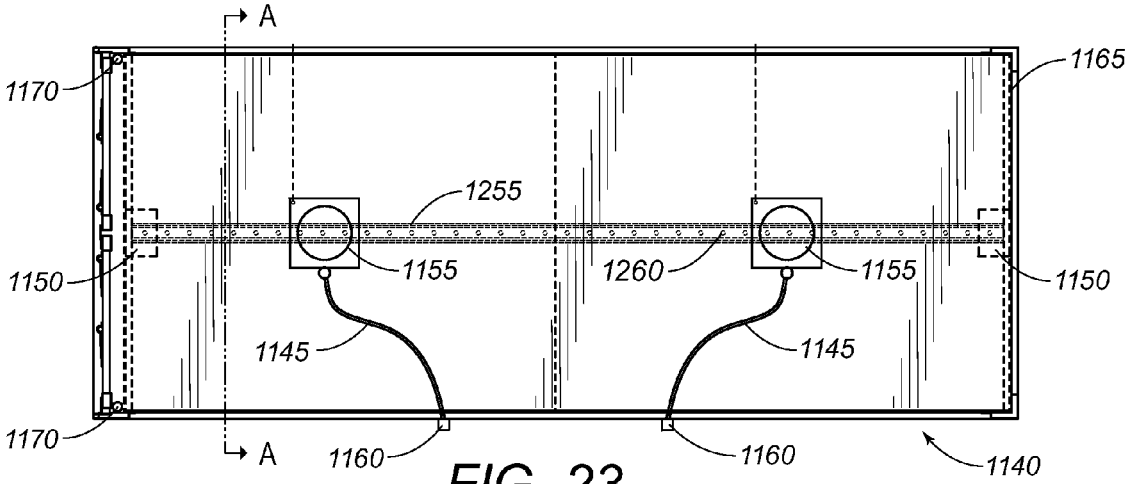
FIG. 23 depicts a plan view of a double wall steel tube with plurality of holes disposed thereupon, functioning as a linear valve according to the preferred embodiment.
Figure 24:
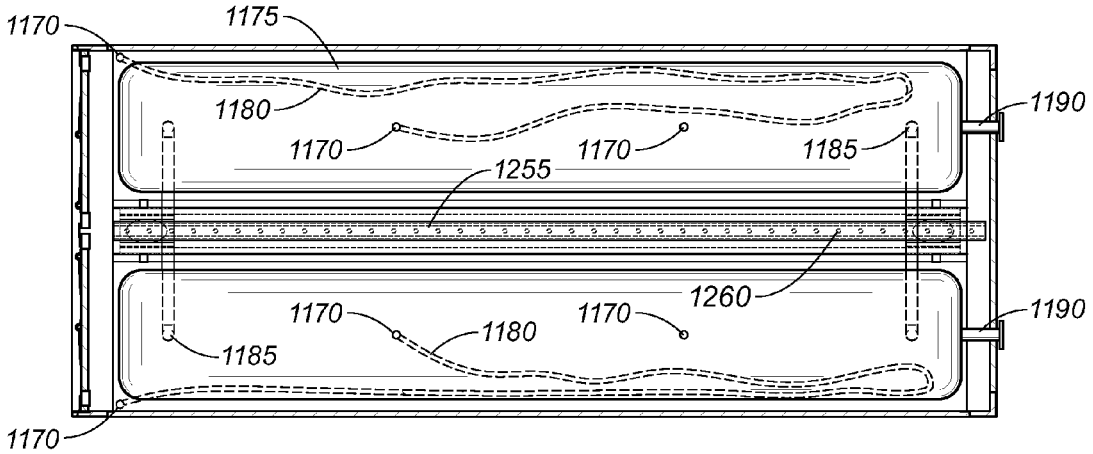
FIG. 24 depicts a cut-away frontal view of pair of longitudinal bladders according to the preferred embodiment.
Figure 25:
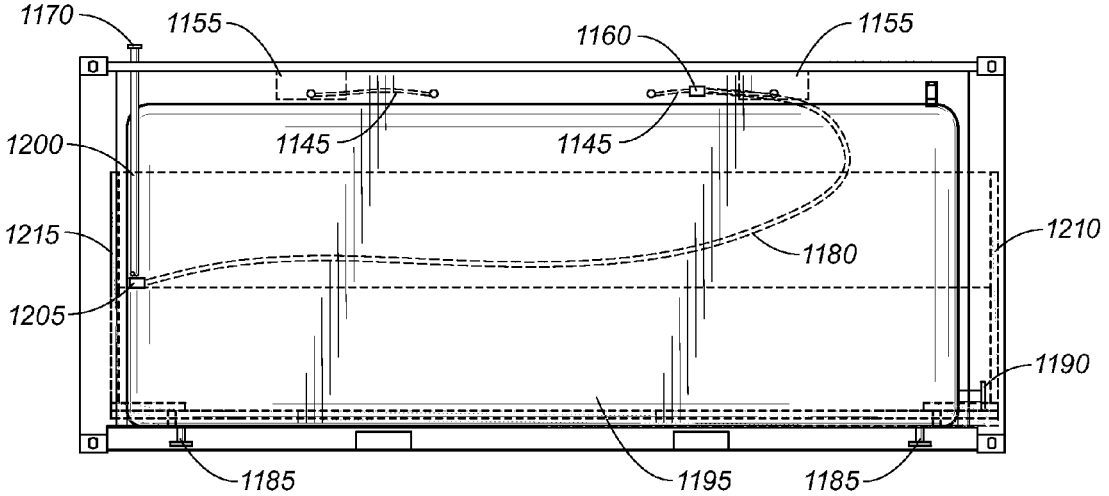
FIG. 25 depicts a side view of the end portion of the pair of bladders depicted in FIG. 24.

FIGS. 23-25 depict cut-away frontal views of the internal linear, longitudinally disposed valve member and functionally related likewise longitudinally disposed pair of elongated bladder members of the preferred embodiments. More particularly, FIG. 23 depicts a plan view of the frac sand delivery protocol taught hereunder comprising double wall steel tube (corresponding to numeral 126 shown in FIGS. 16A-B) with plurality of holes 1260; FIG. 24 depicts a cut-away frontal view of the pair of bladder members 1175 and preferably pair of 3" fill inlet tubes 1190, pair of preferably 1¼" bladder vent tubes, and pair of preferably 2" equalizer tubes 1185 extending through bottom portion thereof. FIG. 25 depicts a side view of the end portion 1195 thereof with preferably ¾" water outlet tube 1145 interconnected with fill inlet 1155 and container wall weld coupling 1160, preferably permanently mounted 2" steel pipe vent with fixed vent nozzle 1205 disposed below the folding hopper bay taught hereunder.

Figure 26:
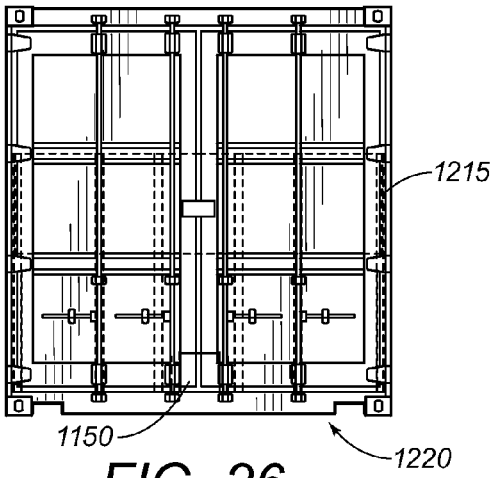
FIG. 26 depicts an elevation view of end door of the preferred embodiment.
Figure 27:
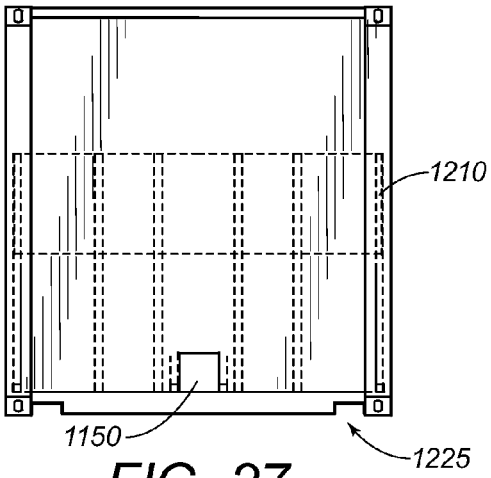
FIG. 27 depicts an elevation view of other, opposite end portion of the preferred embodiment.
Figure 28:
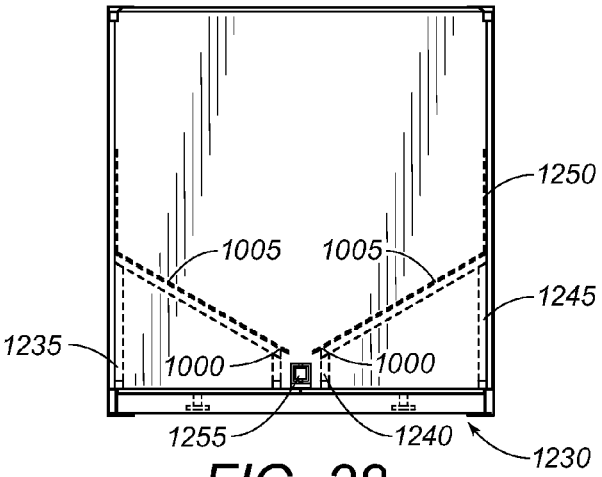
FIG. 28 depicts an elongate section view along line A-A in FIG. 23.

Now referring collectively to FIGS. 23-29, there is shown additional views of the preferred embodiment depicted herein and specifically depicted in FIGS. 23-25. FIG. 26 depicts an elevation view of end door 1220 pivotally attached to welded steel frame structure 1215 the preferred embodiment. Also shown is outlet frame 1150. FIG. 27 depicts an elevation view of other end portion 1225 disposed oppositely of end door 1220. Also shown therein is outlet frame 1150 and preferably 2"×2" tube frame preferably constructed from 4" flat plate steel. FIG. 28 depicts an elongated sectional view 1230 along line A-A in FIG. 23 illustrating preferably rectangular slot 1240 enclosing double wall steel tube 1255. Also shown is hopper hinge member 1000, folding hopper bottom 1005, and hopper truss 1235, wall truss 1245, and main traverse beam 1250. As hereinbefore elucidated, inner square tube is hydraulically actuated and is caused to slide approximately 3" to align or misalign plurality of holes 1260 thereon with substantially identical plurality of holes on outer steel tube. Thus, each of the inner square tube and the outer square tube have comparable plurality of holes. When actuated, the inner tube is caused to slide about 3" to either align both sets of holes, thereby enabling frac sand to be discharged from the hopper member through plurality of discharge ports as hereinbefore described. On the other hand, if such sliding movement causes the plurality of holes of inner tube to be misaligned with the corresponding plurality of holes in the stationary outer tube, then this linear vales is disposed in a closed position and frac sand remains securely stored within transport container embodiment hereof.

Figure 29B:
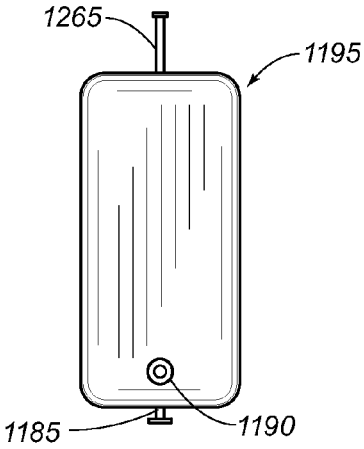
FIG. 29B depicts a side view of the embodiment depicted in FIG. 29A.
Figure 29A:
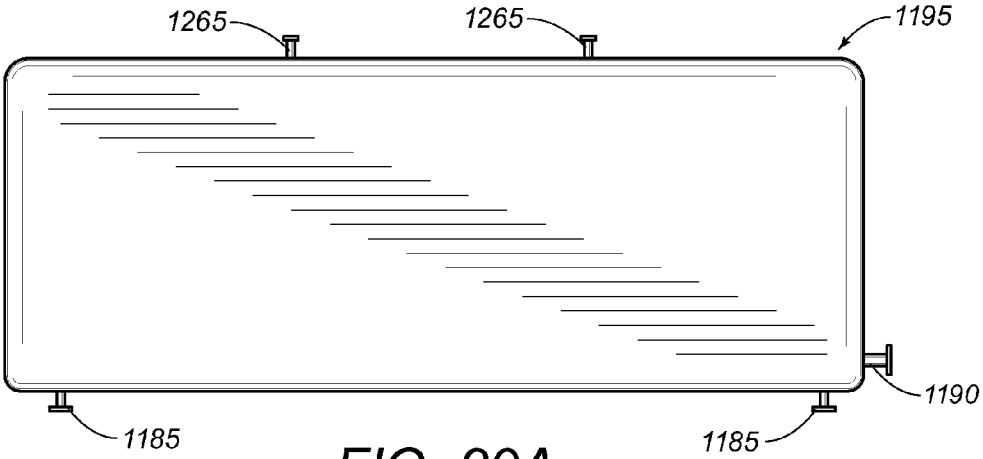
FIG. 29A depicts a simplified external front view of an embodiment of the present invention.

FIGS. 29A-B depict external simplified frontal and side views of another embodiment 1195 of the present invention focusing on preferably plurality of 2" bladder vents, preferably plurality of 2" equalizers, and preferably plurality of 3" fill tube ports.

Thus, a suitably configured plurality of interconnected brace members and truss members is affixed to each side of a dual-modality container's framework interior side walls, front walls, and rear walls to allow attachment of preferably steel or aluminum arm plates that form the contemplated hopper-funnel assembly and enclosed associated linear valve control apparatus. It is seen that embodiments of this hopper assembly enable frac sand to be expeditiously funneled to a central collection trough member. In so doing, the hopper assembly's respective side arm members are angulated at about 30-31° relative to the horizontal to promote downward flow of frac sand material.

Figure 7:
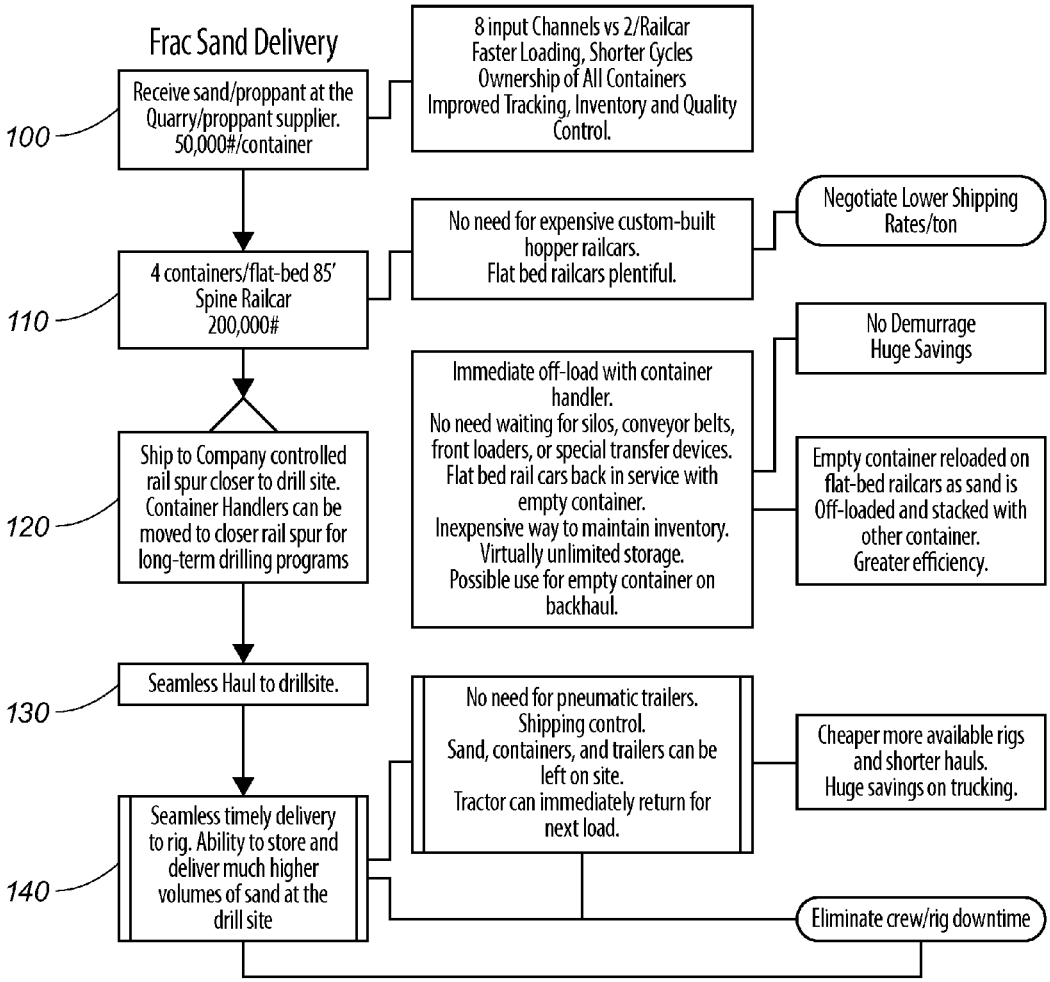
FIG. 7 depicts a system flow chart describing the stepwise logistics of effectuating frac sand delivery according to embodiments of the present invention.

Now referring to FIG. 7, there is depicted a system flow chart of the preferred embodiment of the present invention as applied to a particular frac delivery scenario. In step 300, frac sand and/or proppant are loaded at a quarry or a supplier thereof, e.g., in a 50,000 pound container. In step 310, three containers, corresponding to 150,000 pounds, are emplaced upon a flat-bed or spine railcar. Then, in step 320, these frac sand containers are transported to a trans-loading facility proximal to a well site, thereby necessitating, in step 330, a relatively short haul of the frac sand and proppant to a rig. As appropriate, as will be hereinafter described, in step 340, frac sand and proppant are stored—environmentally safe and waterproof—in a manner heretofore unknown in the art.

Still referring to FIG. 7, block 350 addresses the benefits associated with step 300: 8 input channels as opposed to prior art only 2 input channels; both faster loading of frac sand and shorter cycles of unloading; ownership of all containers, improved tracking, inventory and quality control. Block 360 addresses the benefits associated with step 310: no need for expensive custom-built hopper railcars and flat bed railcars are plentiful. Block 390 further elaborates that now practitioners in the art can negotiate lower shipping rates per ton of frac sand and/or proppant transported.

Similarly, block 370 states that the present invention affords immediate off-load with a container handler, which eliminates a need for silo waiting time, conveyor belts, front loader equipment or other special transfer devices. Additional benefits include virtually unlimited storage and possible use for backhauling empty containers. Block 400 indicates that a huge cost savings is realized by eliminating demurrage charges during idle periods and Block 410 notes that greater efficiency is realized due to container off-load logistics. Related to step 340, Block 380 indicates that there is no longer a need for pneumatic trailers, improved shipping control, ease of leaving sand, container frameworks, trailers on site. Block 420 indicates that significant trucking cost savings follow from rigs being more available and there being shorter hauls and Block 430 indicates that crew and rig downtown has been mitigated due to embodiments of the present invention.

Besides the hereinbefore described steel/aluminum frac sand transport and delivery bimodal container, another embodiment of the modular apparatus contemplated by the present invention corresponds to a bladder apparatus using high-density elastomer and like material. Those skilled in the art will recognize that this bladder apparatus is constructed with material similar to what is typically used in military fuel storage facilities.

It should be understood by those practitioners conversant in the art that, regardless of which frac sand apparatus embodiment is invoked for a particular well site fracking scenario, the present invention teaches implementing or constructing a suitably configured and structurally reinforced bimodal shipping container framework specifically for achieving both efficient frac sand and frac liquid transportation heretofore not contemplated in the art. A particular benefit of herein-described embodiments is facilitating maximum payload delivery of the enclosed materials, and, in so doing, assuring economical delivery thereof. For instance, the instant apparatus and concomitant methodology are designed to deliver nearly 50,000 pounds of frac sand per trip. It will be readily appreciated that any greater payload exceeds highway weight limitations allowed for safe trucking. Of course, any substantially lesser payload adversely impacts transportation economics.

It should also be appreciated that a major economic advantage of the instant container framework dual modality apparatus and concomitant methodology is virtual elimination of pneumatic truck wait/down time at drilling sites. Embodiments of the present invention comprising the container/hopper/trailer assembly structures taught herein can be immediately separated from a truck or the like for subsequent suitable well site positioning and payload delivery. Moreover, elimination of truck idling/waiting time at the drill-site dramatically reduces carbon dioxide emissions—with clear benefit to the environment and to drill-site workers' health.

As will also be appreciated by those skilled in the art, the trailer-and-container assemblies contemplated hereunder are inherently more mobile and consume considerably less space than more cumbersome pneumatic trucks. Indeed, a flatbed trailer chassis is more easily aligned and positioned for faster material transfer at the well site. FIG. 8 depicts a spreadsheet that tabulates a plethora of advantages of embodiments of the present invention. It should be understood that embodiments of the present invention enable frac sand and associated abrasive materials to be loaded at the processor even when there is no hopper car or pneumatic truck available. Once sealed in such embodiment, the integrity of the enclosed material is inherently sustained. Degradation from abrasion and friction during transfers thereof are virtually eliminated. Likewise, possibility of moisture and rain exposure and simultaneous intrusion thereof during transfer have been substantially eliminated.

Furthermore, there is no need for expensive bulk-carrying rail hopper cars to transport the material. A more efficient, reliable and inexpensive methodology according to the teachings of the present invention now exists for maintaining frac fluid inventory—with virtually unlimited storage. Another feature of the present invention heretofore unknown in the frac sand art is not only providing an apparatus for transporting frac sand materials from the supplier thereof to the well site, but also for thereafter transporting spent, flow-back water and associated small amounts of residual hydrocarbons, or crude oil and other hydrocarbon fluids from the well site back to the supplier or like remote sites, wherein vehicles charged with transportation of frac-related materials are no longer devoid thereof. It will be seen that preferred embodiments of the present invention may be configured with a dual modality wherein a first modality enables frac sand to be delivered to the well site, and a second modality enables crude oil or frac water to be transferred from production storage tanks adjacent the well site back to the quarry or recycle facility or like location.

More particularly, referring to FIGS. 16A-B, this unique dual modality may be readily understood. In its first, frac sand hopper modality, the preferred embodiment is suitably configured to store frac sand and then effectively discharge this frac sand through funnel member of the funnel-hopper assembly into plurality of outlet ports at the well site to support fracking operations. In its second internal bladder modality, the preferred embodiment is configured to receive inflowing spent frac water including small amounts of residual liquid hydrocarbons, or crude oil effectuating substantially proportional inflation of its bilateral bladder members. Contrary to the teachings of the prior art, this dual modality-functionality is seamlessly accomplished in situ by invoking embodiments of the container framework exemplified herein. Indeed, preferred embodiments hereof may be construed as triggering a metamorphosis of the frac art because the logistics and safety associated with hydrocarbon fracking operations have been unexpectedly improved to such an extent that several long-standing problems and limitations of the prior art have been eliminated.

As shown in FIG. 16A, the preferred embodiment is configured in the frac sand transportation modality. Pair of internal plate arm members Q and R, under the influence of heavy duty hinge 123, are preferably hydraulically oriented at an angle of 31° relative to the horizontal axis, whereupon its hopper modality has been established. Consequently, up to 50,000 pounds of frac sand is loaded into hopper-funnel 50, with each of pair of bladder members 124A and 124B disposed in a deflated condition.

Contrariwise, now referring to the internal configuration depicted in FIG. 16B, after being unloaded of frac sand expeditiously and apace as hereinbefore described, whereupon hopper-funnel member is devoid of any frac sand, pair of internal plates arm members Q and R, under the influence of heavy duty hinge member 123, are preferably oriented at an angle of 90° relative to the vertical axis, whereupon its pair of internal bladder members 124A and 124B are gradually inflated by the inflow of crude oil and other fluids including water. Accordingly, its frac liquid transport or bladder modality has been established. Similarly, as shown in FIG. 8, hopper plate arm members Q and R have been fully rotated and pair of bladder members 124A and 124B have been filled to capacity with 50,000 pounds of liquid.

It should now be evident to those skilled in the art that preferred embodiments teach a specially constructed bimodal container profoundly useful as frac sand apparatus for transporting its fully loaded charge to well sites where fracking operations will be effectuated, and for transporting hydrocarbon fluids and flow-back frac water from the well site elsewhere remote of the well site. Depicted are pair of square channel brake press steel plate doors 121 which rotate from the vertical to angle of 30° from the horizontal depending upon on-hand materials. Heavy duty hinge joint 123 enables the doors to rotate through an angle of 60° as appropriate. Each of pair of bladders 124A-B preferably comprises 1.5 mm polyvinyl chloride foldable, inflatable bladder, having a 25,000 pound capacity for accommodating hydrocarbon fluid or water.

Other frac sand transport apparatus variations and modifications will, of course, become apparent from a consideration of the structures and techniques hereinbefore described and depicted. Nevertheless, it should be clearly understood that the present invention is not intended to be limited by the particular features and structures hereinbefore described and depicted in the accompanying drawings, but that the present invention is to be measured by the scope of the appended claims.

What is claimed is:

1. A frac sand transporting container comprising:

a first plurality of walls having a first pair of parallel longitudinal walls and a second pair of parallel transverse walls, with said second pair of parallel transverse walls perpendicular to said first pair of parallel longitudinal walls, with one wall of said pair of transverse walls having a door disposed thereupon, and also having a floor and a roof perpendicular to said plurality of walls;

a second plurality of frac sand input ports disposed atop said roof with each of said frac sand input ports coupled with a first output pipe located in situ at a frac sand processing facility;

a third plurality of quick-connect valves attached to said plurality of walls, for controlling frac liquid flow into like third plurality of input ports interconnected therewith;

a fourth plurality of quick-connect valves also attached to said plurality of walls, for controlling frac liquid flow out of like fourth plurality of output discharge ports interconnected therewith;

a crossbrace and truss framework enclosed within and affixed to said first plurality of walls, said floor and said roof, for reinforcing the strength thereof;

a dual modality hopper assembly disposed within and affixed to said crossbrace and truss framework and forming a sealable enclosure for receiving from said second plurality of frac sand input ports frac sand when configured in a first modality, with said frac sand collected and stored in a central chamber member disposed therewithin;

said dual modality hopper assembly receiving from said third plurality of frac liquid input ports frac liquid when configured in a second modality, with said frac liquid collected and stored in a bilateral elongated bladder member disposed longitudinally of said central chamber member throughout the length thereof;

said central chamber member further disposed parallel to and longitudinally of said floor throughout the length thereof, and comprising a pair of elongated arm members pivotably affixed thereto at their vertex to a hinge member, with said pair of elongated arm members, in turn, pivoting from a first position disposed at an angle of about 30° relative to said floor to a second position disposed at an angle of about 85° relative to said floor;

a fifth plurality of output discharge ports disposed upon an external transverse surface of said dual modality hopper assembly, with each said output discharge port thereof coupled to a second discharge pipe located in situ at a well site for transfer of said frac sand from said central chamber member downhole;

each output discharge port of said fourth plurality of output discharge ports coupled to a second discharge pipe for transfer of said frac liquid downhole or transfer to a third discharge pipe located in situ at a recycle facility;

an elongated linear hydraulic valve disposed longitudinally of said frac sand container floor and comprising an elongated fixed outer tube disposed annularly of an elongated slidable inner tube, with each of said inner tube and said outer tube having a like sixth plurality of holes disposed upon and throughout the surface thereof; and said inner tube hydraulically urged to slidably either align its sixth plurality of holes with corresponding sixth plurality of holes of said outer tube, thereby emplacing said elongated linear valve in an open position allowing outflow therethrough, or to misalign its sixth plurality of holes with corresponding sixth plurality of holes of said outer tube, thereby emplacing said elongated linear valve in a closed position preventing outflow therethrough.

2. The frac sand transporting container recited in claim 1, wherein said hinge member remains hydraulically deactivated thereby sustaining said bilateral bladder member being deflated beneath said pair of elongated arm members which remain in said first position disposed at an angle of about 30° relative to said floor.

3. The frac sand transporting apparatus recited in claim 1, wherein said hinge member is hydraulically activated thereby causing said bilateral bladder member to be inflated beneath said pair of elongated arm members urging pivotal movement thereof from said first position disposed at an angle of about 30° to said second position disposed at an angle of about 85°, both said first and said second position being angulated relative to said floor.

* * * * *